US010006678B2

(12) United States Patent
Takayama et al.

(10) Patent No.: US 10,006,678 B2
(45) Date of Patent: Jun. 26, 2018

(54) AIR-CONDITIONING APPARATUS

(75) Inventors: Keisuke Takayama, Tokyo (JP); Koji Azuma, Tokyo (JP); Yuji Motomura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 829 days.

(21) Appl. No.: 14/235,898

(22) PCT Filed: Aug. 19, 2011

(86) PCT No.: PCT/JP2011/004639
§ 371 (c)(1),
(2), (4) Date: Jan. 29, 2014

(87) PCT Pub. No.: WO2013/027233
PCT Pub. Date: Feb. 28, 2013

(65) Prior Publication Data

US 2014/0150483 A1 Jun. 5, 2014

(51) Int. Cl.
*F25B 49/00* (2006.01)
*F25B 30/02* (2006.01)
(Continued)

(52) U.S. Cl.
CPC ..... *F25B 30/02* (2013.01); *F25B 13/00* (2013.01); *F25B 25/005* (2013.01); *F25B 49/00* (2013.01);
(Continued)

(58) Field of Classification Search
CPC ..... F25B 2313/0231; F25B 2313/0233; F25B 25/005
See application file for complete search history.

(56) References Cited

U.S. PATENT DOCUMENTS 9,303,904 B2 * 4/2016 Yamashita ..... F25B 13/00
2002/0026803 A1 * 3/2002 Inoue ..... F25B 13/00 62/228.3
(Continued)

FOREIGN PATENT DOCUMENTS

EP 2 284 456 A1 2/2011
EP 2 341 295 A1 7/2011
(Continued)

OTHER PUBLICATIONS

International Search Report of the International Searching Authority dated Oct. 25, 2011 for the corresponding international application No. PCT/JP2011/004639 (and English translation).
Office Action dated Feb. 10, 2015 in the corresponding CN Application No. 201180072931.7 (with English translation).
(Continued)

*Primary Examiner* — Ljiljana Ciric
*Assistant Examiner* — Alexis Cox
(74) *Attorney, Agent, or Firm* — Posz Law Group, PLC

(57) ABSTRACT

An air-conditioning apparatus includes a intermediate heat exchangers operating as a condenser or an evaporator and allows each intermediate heat exchanger to exchange heat between a refrigerant heated or cooled in a refrigeration cycle on a heat source side and a heat transfer medium flowing through a heat transfer medium circuit on a use side such that heat energy produced on the heat source side is transmitted to use side heat exchangers. A controller calculates the heat transfer medium temperature difference between a heat transfer medium inlet and outlet temperatures. When a detected value of a heat transfer medium temperature detecting device deviates from a predetermined range, the controller changes the target heat transfer medium temperature difference and controls a heat transfer medium flow control device, such that the heat transfer medium temperature difference reaches the changed target heat transfer medium temperature difference.

11 Claims, 8 Drawing Sheets

(51) Int. Cl.
*F25B 13/00* (2006.01)
*F25B 25/00* (2006.01)
*F25B 49/02* (2006.01)

(52) U.S. Cl.
CPC ..... *F25B 49/02* (2013.01); *F25B 2313/0231* (2013.01); *F25B 2313/0232* (2013.01)

(56) References Cited

U.S. PATENT DOCUMENTS

| | | | | |
|---|---|---|---|---|
| 2011/0146339 | A1* | 6/2011 | Yamashita | F24F 3/06 62/513 |
| 2011/0185754 | A1* | 8/2011 | Yamashita | F24F 3/06 62/132 |
| 2011/0192184 | A1* | 8/2011 | Yamashita | F24F 1/02 62/196.1 |
| 2011/0197608 | A1* | 8/2011 | Yamashita | F24F 3/06 62/190 |

FOREIGN PATENT DOCUMENTS

| | | | | |
|---|---|---|---|---|
| EP | 2 341 297 | A1 | 7/2011 | |
| JP | 05-071770 | A | 3/1993 | |
| JP | 2004-060956 | A | 2/2004 | |
| JP | 2005-069554 | A | 3/2005 | |
| JP | 2010-196946 | A | 9/2010 | |
| JP | 2010-196950 | A | 9/2010 | |
| WO | 2010/049999 | A1 | 5/2010 | |
| WO | 2010/113296 | A1 | 10/2010 | |
| WO | 2010/131378 | A1 | 11/2010 | |
| WO | 2011/052040 | A1 | 5/2011 | |
| WO | WO 2011052049 | A1 * | 5/2011 | F25B 13/00 |
| WO | 2011/064814 | A1 | 6/2011 | |
| WO | 2011/080800 | A1 | 7/2011 | |

OTHER PUBLICATIONS

Extended European Search Report dated Apr. 8, 2015 issued in corresponding EP patent application No. 11871309.8.

* cited by examiner

AIR-CONDITIONING APPARATUS

CROSS REFERENCE TO RELATED APPLICATION

This application is a U.S. national stage application of International Application No. PCT/JP2011/004639 filed on Aug. 19, 2011, the disclosure of which is incorporated by reference.

TECHNICAL FIELD

The present invention relates to an air-conditioning apparatus which is used as, for example, a multi-air-conditioning apparatus for a building.

BACKGROUND ART

Related-art air-conditioning apparatuses, used as building multi-air-conditioning apparatuses, include an air-conditioning apparatus in which an intermediate heat exchanger is allowed to exchange heat between a refrigerant heated or cooled on a heat source side and a heat medium flowing through a use side circuit such that heat energy produced on the heat source side is transmitted to a use side heat exchanger (i.e., an indoor unit) (refer to Patent Literature 1, for example). The air-conditioning apparatus disclosed in Patent Literature 1 detects the difference in temperature (hereinafter, referred to as the "indoor-unit inlet-outlet temperature difference") between the heat medium flowing into the use side heat exchanger and that flowing out of the use side heat exchanger. This air-conditioning apparatus is configured such that, when the indoor-unit inlet-outlet temperature difference is less than a control target value, the area of opening of a flow control valve is reduced to reduce the flow rate of the heat medium flowing through the use side heat exchanger, and when the temperature difference is greater than the control target value, the area of opening of the flow control valve is increased to increase the flow rate of the heat medium flowing through the use side heat exchanger, such that the indoor-unit inlet-outlet temperature difference approaches the control target value. Accordingly, the heat medium is supplied according to a heat load on the use side heat exchanger. Patent Literature 1 further discloses an arrangement in which a plurality of intermediate heat exchangers (described as "intermediate heat exchangers" in Patent Literature 1) are connected to a refrigeration cycle on the heat source side.

Patent Literature 2 discloses another related-art air-conditioning apparatus in which an intermediate heat exchanger is allowed to exchange heat between a refrigerant heated or cooled on a heat source side and a heat medium flowing through a use side circuit such that heat energy produced on the heat source side is transmitted to a use side heat exchanger (i.e., an indoor unit). The air-conditioning apparatus (referred to as a "heat pump system" in Patent Literature 2) disclosed in Patent Literature 2 controls the circulation rate of the refrigerant on the basis of a first target temperature which is the temperature of the heat medium (referred to as an "aqueous medium" in Patent Literature 1) at an outlet of the intermediate heat exchanger (referred to as a "use side heat exchanger" in Patent Literature 1) and controls the operating capacity of a circulation pump for circulating the heat medium such that the temperature difference between the heat medium flowing into the intermediate heat exchanger and that flowing out of the intermediate heat exchanger reaches a second target temperature difference. In the air-conditioning apparatus disclosed in Patent Literature 2, when the temperature difference between the heat medium flowing into the intermediate heat exchanger and that flowing out of the intermediate heat exchanger is less than the second target temperature difference and the temperature of the heat medium at the outlet of the intermediate heat exchanger is higher than or equal to the first target temperature, the operating capacity of the circulation pump is reduced. On the other hand, when the temperature difference between the heat medium flowing into the intermediate heat exchanger and that flowing out of the intermediate heat exchanger is greater than the second target temperature difference, the operating capacity of the circulation pump is increased. Furthermore, Patent Literature 2 discloses an arrangement in which a plurality of intermediate heat exchangers are connected in parallel with a refrigeration cycle on the heat source side.

CITATION LIST

Patent Literature

Patent Literature 1: International Publication No. WO 2010/049999

Patent Literature 2: Japanese Unexamined Patent Application Publication No. 2010-196946

SUMMARY OF INVENTION

Technical Problem

In the air-conditioning apparatus disclosed in Patent Literature 1, the constant control target value for the indoor-unit inlet-outlet temperature difference of the heat medium causes the following disadvantages. Typically, the intermediate heat exchanger has a heat transfer area that allows exchange of heat corresponding to the rated capacity of the indoor unit (use side heat exchanger). Accordingly, if an air conditioning load decreases, for example, while only the use side heat exchanger having a small capacity is operated in the building multi-air-conditioning-apparatus capable of performing a partial load operation, the flow rate of the heat medium flowing into the intermediate heat exchanger decreases, so that the temperature efficiency ratio for the heat medium of the intermediate heat exchanger is increased.

Consequently, the temperature of the heat medium flowing into the use side heat exchanger rises. If the indoor-unit inlet-outlet temperature difference is controlled to a given control target value, therefore, the air conditioning capacity would be increased by an increment in temperature difference between the heat medium and air in an air-conditioning target space. Disadvantageously, this would lead to an excessive increase in temperature of air blown during a heating operation or an excessive reduction in temperature of air blown during a cooling operation. Furthermore, an excess of air conditioning capacity would cause start-stop loss.

In the air-conditioning apparatus disclosed in Patent Literature 2, in the case where the temperature difference between the heat medium flowing into the intermediate heat exchanger and that flowing out of the intermediate heat exchanger is less than the second target temperature difference and the temperature of the heat medium at the outlet of the intermediate heat exchanger is higher than or equal to the first target temperature, the operating capacity of the circulation pump is reduced such that the temperature difference between the heat medium flowing into the intermediate heat exchanger and that flowing out of the intermediate heat exchanger is controlled so as to reach the second target temperature difference. In this case, the temperature difference between the heat medium flowing into the intermediate heat exchanger and that flowing out of the intermediate heat exchanger is consistently controlled to such a given control target value. Unfortunately, the air-conditioning apparatus disclosed in Patent Literature 2 has disadvantages similar to those in the air-conditioning apparatus disclosed in Patent Literature 1.

In the air-conditioning apparatus disclosed in Patent Literature 2, the circulation rate of the refrigerant is controlled such that the temperature of the heat medium flowing out of the intermediate heat exchanger reaches the first target temperature. For example, in the case where a plurality of intermediate heat exchangers which simultaneously perform the same function as a condenser or an evaporator in the refrigeration cycle on the heat source side are connected, it is very difficult to set the circulation rate of the refrigerant because the air conditioning load applied differs from intermediate heat exchanger to intermediate heat exchanger.

The present invention has been made to overcome the above-described disadvantages and provides an air-conditioning apparatus which includes a plurality of intermediate heat exchangers capable of simultaneously performing the same function as a condenser or an evaporator and in which the intermediate heat exchangers are allowed to exchange heat between a refrigerant heated or cooled on a heat source side and a heat medium flowing through a use side circuit such that heat energy produced on the heat source side is transmitted to a use side heat exchanger (i.e., an indoor unit), the air-conditioning apparatus being capable of preventing an excess of air conditioning capacity even upon reduction in air conditioning load.

Solution to Problem

The present invention provides an air-conditioning apparatus including a refrigeration cycle in which a compressor, refrigerant passages of a plurality of intermediate heat exchangers each operating as a condenser or an evaporator, an expansion device, and a heat source side heat exchanger are connected by pipes and through which a refrigerant circulates; a heat medium circuit which is provided for each of the intermediate heat exchangers and in which a heat medium passage of the intermediate heat exchanger, a heat medium circulating device, at least one use side heat exchanger, and a heat medium flow control device disposed corresponding to the use side heat exchanger are connected by pipes and through which a heat medium circulates; a controller configured to control the heat medium flow control device in order to adjust the flow rate of the heat medium flowing through the use side heat exchanger corresponding to the heat medium flow control device; a first heat medium temperature detecting device configured to detect the temperature of the heat medium flowing into the use side heat exchanger; and a second heat medium temperature detecting device disposed corresponding to the use side heat exchanger, the second heat medium temperature detecting device being configured to detect the temperature of the heat medium flowing out of the use side heat exchanger. At least two of the intermediate heat exchangers are configured to be able to simultaneously perform the same function as a condenser or an evaporator, wherein the controller calculates the difference between a detected value of the first heat medium temperature detecting device and a detected value of the second heat medium temperature detecting device to obtain a heat medium temperature difference for the use side heat exchanger in operation and controls the heat medium flow control device such that the heat medium temperature difference reaches a target heat medium temperature difference, and wherein when the detected value of the first heat medium temperature detecting device deviates from a predetermined range, the controller changes the target heat medium temperature difference and controls the heat medium flow control device corresponding to at least one of the use side heat exchanger, in operation such that the heat medium temperature difference reaches the changed target heat medium temperature difference.

Advantageous Effects of Invention

According to the present invention, when the temperature of the heat medium flowing into the use side heat exchanger deviates from a predetermined stable range, the target heat medium temperature difference for the use side heat exchanger is changed. Accordingly, upon reduction in air conditioning load on the intermediate heat exchanger decreases (for example, reduction in the number of use side heat exchangers operating for heating), if the temperature efficiency ratio of the intermediate heat exchanger increases and this results in an increase of the difference in temperature between the heat medium and air in an air-conditioning target space, an excess of air-conditioning capacity can be prevented by changing the target heat medium temperature difference. According to the invention, therefore, an excessive increase in temperature of air blown during a heating operation and an excessive reduction in temperature of air blown during a cooling operation can be prevented in a configuration with a plurality of intermediate heat exchangers capable of simultaneously performing the same function as a condenser or an evaporator, thus providing comfort to a user. Furthermore, the occurrence of start-stop loss or the like can be prevented.

DESCRIPTION OF EMBODIMENTS

Embodiment

Figure 1:
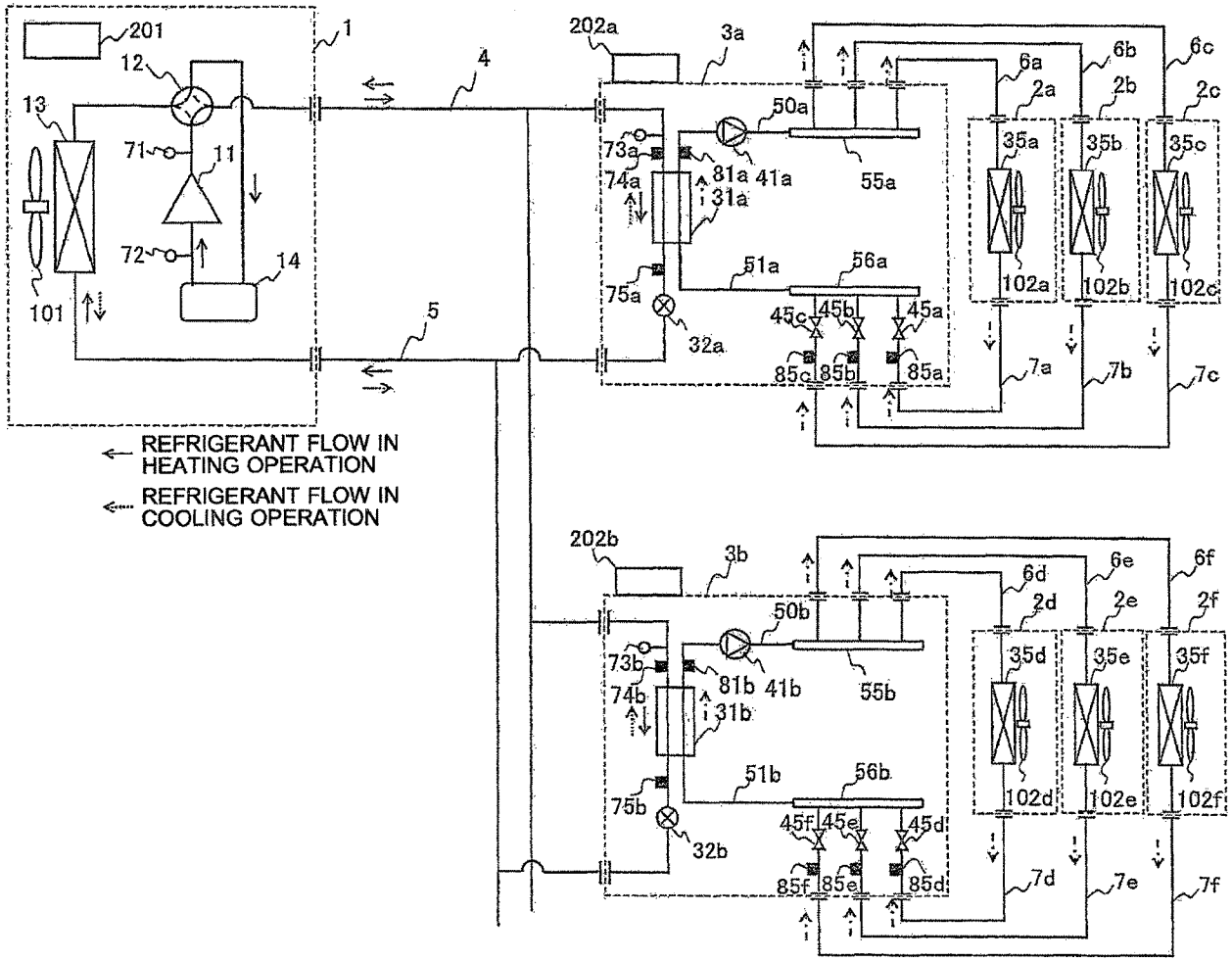
FIG. 1 is a system circuit diagram of an air-conditioning apparatus according to Embodiment of the present invention.

An air-conditioning apparatus according to Embodiment will be described below. In the following description, letters of the alphabet may be added to the last digits of reference numerals if components having the same configuration have to be distinguished from each other.

FIG. 1 is a system circuit diagram of the air-conditioning apparatus according to Embodiment of the present invention. The air-conditioning apparatus according to Embodiment includes a refrigeration cycle including a compressor 11, a four-way valve 12, serving as a refrigerant flow switching device, a heat source side heat exchanger 13, an accumulator 14, intermediate heat exchangers 31, and expansion devices 32, such as electronic expansion valves, such that these components are connected by pipes.

More specifically, the compressor 11 is configured to compress a sucked refrigerant and discharge (or deliver) the resultant refrigerant. The four-way valve 12 is configured to connect a passage for the refrigerant discharged from the compressor 11 to the heat source side heat exchanger 13 or the intermediate heat exchangers 31 depending on an operation mode. According to Embodiment, a circulation path is switched between a circulation path for a cooling operation (during which ail of operating indoor units 2 perform cooling (including dehumidifying, the same applying to the following)) and a circulation path for a heating operation (during which all of the operating indoor units 2 perform heating)).

The heat source side heat exchanger 13 includes a heat transfer pipe through which the refrigerant flows, fins (not illustrated) for increasing the area of heat transfer between the refrigerant flowing through the heat transfer pipe and outside air, and a fan 101 for blowing air, and is configured to exchange heat between the refrigerant and the air (outside air). For example, during the heating operation, the heat source side heat exchanger 13 functions as an evaporator such that the refrigerant is evaporated and gasified (or turned into a gas). On the other hand, during the cooling operation, the heat source side heat exchanger 13 functions as a condenser or gas cooler (hereinafter, referred to as a "condenser"). In some cases, the refrigerant may be in a two-phase gas-liquid mixed state (two-phase gas-liquid refrigerant) without being completely gasified or liquefied. And the numbers are not restricted as long as it is equal to or greater than 2.

Each intermediate heat exchanger 31 includes a heat transfer portion through which the refrigerant passes and a heat transfer portion through which a heat medium passes and is configured to exchange heat between these media, that is, the refrigerant and the heat medium. According to Embodiment, the intermediate heat exchanger 31 functions as a condenser during the heating operation to heat the heat medium such that the refrigerant is allowed to transfer heat. On the other hand, the intermediate heat exchanger 31 functions as an evaporator during the cooling operation to cool the heat medium such that the refrigerant is allowed to remove heat. Each expansion device 32, such as an electronic expansion valve, is configured to control the flow rate of the refrigerant so as to reduce the pressure of the refrigerant. According to Embodiment, two intermediate heat exchangers 31 (intermediate heat exchangers 31*a* and 31*b*) and two expansion devices 32 (expansion devices 32*a* and 32*b*) arranged so as to correspond to the respective intermediate heat exchangers 31 are arranged. One combination of the intermediate heat exchanger 31*a* and the expansion device 32*a* and the other combination of the intermediate heat exchanger 31*b* and the expansion device 32*b* are connected in parallel between the four-way valve 12 and the heat source side heat exchanger 13. Note that two or more intermediate heat exchangers 31 may be arranged.

The accumulator 14 is disposed on a suction side of the compressor 11. The accumulator 14 functions to store an excess of the refrigerant in the refrigeration cycle and prevent a large amount of liquid refrigerant from returning to and damaging the compressor 11.

As regards the refrigerant on the heat source side, a single refrigerant, such as R-22 or R-134a, a near-azeotropic refrigerant mixture, such as R-410A or R-404A, a non-azeotropic refrigerant mixture, such as R-407C, a refrigerant which contains a double bond in its chemical formula and has a relatively low global warming potential, such as $CF_3CF{=}CH_2$, a mixture containing the refrigerant, or a natural refrigerant, such as $CO_2$ or propane, can be used.

The air-conditioning apparatus according to Embodiment further includes heat medium circuits each including the intermediate heat exchanger 31, use side heat exchangers 35, a pump 41, serving as a heat medium circulating device, and heat medium flow control devices 45 arranged so as to correspond to the respective use side heat exchangers 35 such that these components are connected by pipes.

Each pump 41, serving as a heat medium circulating device, is configured to compress the heat medium to circulate it. In the pump 41, the flow rate (discharge flow rate) of the heat medium discharged can be varied by changing the rotation speed of a built-in motor (not illustrated) within a given range. Each use side heat exchanger 35 is disposed in an indoor unit 2 and is configured to exchange heat between the heat medium and air sent by a fan 102 from an air-conditioning target space so as to heat or cool the air in the air-conditioning target space. According to Embodiment, three use side heat exchangers 35 are arranged in each heat medium circuit. More specifically, a heat medium dividing portion 55 is connected through a first heat medium passage 50 to an outlet side of a heat medium passage of each intermediate heat exchanger 31 and a heat medium combining portion 56 is connected through a second heat medium passage 51 to an inlet side of the heat medium passage of the intermediate heat exchanger 31. The three use side heat exchangers 35 are connected in parallel with the heat medium dividing portion 55 and the heat medium combining portion 56. The heat medium flow control device 45, such as a two-way flow control valve, is provided for each use side heat exchanger 35 and is configured to control the flow rate of the heat medium flowing into the use side heat exchanger 35. Although the heat medium flow control device 45 is disposed between the corresponding use side heat exchanger 35 and the heat medium combining portion 56 in Embodiment, the heat medium flow control device 45 may be disposed between the heat medium dividing portion 55 and the use side heat exchanger 35.

The heat medium circuit is provided for each of the intermediate heat exchangers 31*a* and 31*b*. Specifically, the heat medium circuit, in which the intermediate heat exchanger 31*a* is connected, includes the intermediate heat exchanger 31*a*, use side heat exchangers 35*a*, 35*b*, and 35*c*, a pump 41*a*, and heat medium flow control devices 45*a*, 45*b*, and 45*c* such that these components are connected by pipes. The heat medium circuit, in which the intermediate heat exchanger 31*b* is connected, includes the intermediate heat exchanger 31*b*, use side heat exchangers 35*d*, 35*e*, and 35*f*, a pump 41*b*, and heat medium flow control devices 45*d*, 45*e*, and 45*f* such that these components are connected by pipes. Note that any number of use side heat exchangers 35 and any number of heat medium flow control devices 45 may be provided.

The air-conditioning apparatus according to Embodiment further includes various sensors.

A pressure sensor 71, serving as a refrigerant pressure detecting device, is disposed between a discharge side of the compressor 11 and the four-way valve 12 and detects a discharge pressure. A pressure sensor 72 is disposed between the accumulator 14 and the compressor 11 and detects a suction pressure. A pressure sensor 73*a* is disposed between the intermediate heat exchanger 31*a* and a gas pipe 4 (pipe connecting the four-way valve 12 to the intermediate heat exchanger 31*a*, as will be described later) and a pressure sensor 73*b* is disposed between the intermediate heat exchanger 31*b* and the gas pipe 4 (pipe connecting the four-way valve 12 to the intermediate heat exchanger 31*b*), as will be described later. The pressure sensors 73*a* and 73*b* detect the pressure of the refrigerant flowing through the intermediate heat exchangers 31*a* and 31*b*, respectively. The pressure sensor 73*a* may be disposed between the intermediate heat exchanger 31*a* and the expansion device 32*a* and the pressure sensor 73*b* may be disposed between the intermediate heat exchanger 31*b* and the expansion device 32*b*. Each of the pressure sensors 71 and 72 may be disposed at any position where the discharge pressure or the suction pressure of the compressor 11 can be detected.

Temperature sensors 74*a* and 74*b* each serve as a refrigerant temperature detecting device. The temperature sensor 74*a* is disposed between the gas pipe 4 and the intermediate heat exchanger 31*a* and the temperature sensor 74*b* is disposed between the gas pipe 4 and the intermediate heat exchanger 31*b*. The temperature sensors 74*a* and 74*b* detect the temperature of the refrigerant flowing into the intermediate heat exchangers 31*a* and 31*b*, respectively, during the heating operation. In other words, the temperature sensors 74*a* and 74*b* detect the temperature of the refrigerant flowing out of the intermediate heat exchangers 31*a* and 31*b*, respectively, during the cooling operation. A temperature sensor 75*a* is disposed between the intermediate heat exchanger 31*a* and the expansion device 32*a* and a temperature sensor 75*b* is disposed between the intermediate heat exchanger 31*b* and the expansion device 32*b*. The temperature sensors 75*a* and 75*b* detect the temperature of the refrigerant flowing out of the intermediate heat exchangers 31*a* and 31*b*, respectively, during the heating operation. In other words, the temperature sensors 75*a* and 75*b* detect the temperature of the refrigerant flowing into the intermediate heat exchangers 31*a* and 31*b*, respectively, during the cooling operation.

Temperature sensors 81*a* and 81*b* each serve as a heat medium temperature detecting device. The temperature sensor 81*a* is disposed between a heat medium outlet of the intermediate heat exchanger 31*a* and heat medium inlets of the use side heat exchangers 35*a*, 35*b*, and 35*c*. The temperature sensor 81*b* is disposed between a heat medium outlet of the intermediate heat exchanger 32*b* and heat medium inlets of the use side heat exchangers 35*d*, 35*e*, and 35*f*. The temperature sensors 81*a* and 81*b* detect a heat medium outlet temperature (the temperature of the heat medium flowing out of the intermediate heat exchangers 31*a* and 32*b*) of the intermediate heat exchangers 31*a* and 32*b*, respectively. Temperature sensors 85*a*, 85*b*, 85*c*, 85*d*, 85*e*, and 85*f* are arranged such that each sensor is disposed between a heat medium outlet of the corresponding one of the use side heat exchangers 35*a*, 35*b*, 35*c*, 35*d*, 35*e*, and 35*f* and a heat medium inlet of the corresponding one of the intermediate heat exchangers 31*a* and 32*b*. The temperature sensors 85*a*, 85*b*, 85*c*, 85*d*, 85*e*, and 85*f* detect a heat medium outlet temperature (the temperature of the heat medium flowing out of the use side heat exchangers 35*a*, 35*b*, 35*c*, 35*d*, 35*e*, and 35*f*) of the use side heat exchangers 35*a*, 35*b*, 35*c*, 35*d*, 35*e*, and 35*f*, respectively.

The temperature sensors 81*a* and 81*b* each correspond to a first heat-medium temperature detecting device in the present invention. The temperature sensors 85*a*, 85*b*, 85*c*, 85*d*, 85*e*, and 85*f* each correspond to a second heat-medium temperature detecting device in the invention.

The above-described components except the pipes are accommodated in a heat source unit 1 (outdoor unit), relay units 3, and the indoor units 2.

Specifically, the heat source unit 1 (outdoor unit) accommodates the compressor 11, the four-way valve 12, the heat source side heat exchanger 13, and the accumulator 14. The heat source unit 1 further accommodates a controller 201 that controls the heat source unit 1 and the whole of the air-conditioning apparatus. Indoor units 2*a*, 2*b*, 2*c*, 2*d*, 2*e*, and 2*f* accommodate the use side heat exchangers 35*a*, 35*b*, 35*c*, 35*d*, 35*e*, and 35*f*, respectively. A relay unit 3*a* accommodates the intermediate heat exchanger 31*a*, the pump 41*a*, and the heat medium flow control devices 45*a*, 45*b*, and 45*c*. The relay unit 3*a* further accommodates a controller 202*a* that controls the relay unit 3*a*. A relay unit 3*b* accommodates the intermediate heat exchanger 31*b*, the pump 41*b*, and the heat medium flow control devices 45*d*, 45*e*, and 45*f*. The relay unit 3*b* further accommodates a controller 202*b* that controls the relay unit 3*b*.

The heat source unit 1 is connected to the relay units 3*a* and 3*b* by the gas pipes 4 and liquid pipes 5 which serve as refrigerant pipes. Specifically, the four-way valve 12 is connected to the intermediate heat exchangers 31*a* and 31*b* via the gas pipes 4 and the expansion devices 32*a* and 32*b* are connected to the heat source side heat exchanger 13 via the liquid pipes 5.

Furthermore, the relay unit 3*a* is connected to the indoor units 2*a*, 2*b*, and 2*c* (use side heat exchangers 35*a*, 35*b*, and 35*c*) by heat medium supply passages 6*a*, 6*b*, and 6*c* and heat medium return passages 7*a*, 7*b*, and 7*c*, respectively, through which a safe heat medium, such as water or antifreeze, flows. In other words, the relay unit 3*a* is connected to each of the indoor units 2*a*, 2*b*, and 2*c* (use side heat exchangers 35*a*, 35*b*, and 35*c*) by a single heat medium path. Similarly, the relay unit 3*b* is connected to each of the indoor units 2*d*, 2*e*, and 2*f* (use side heat exchangers 35*d*, 35*e*, and 35*f*) by a single heat medium path.

Figure 2:
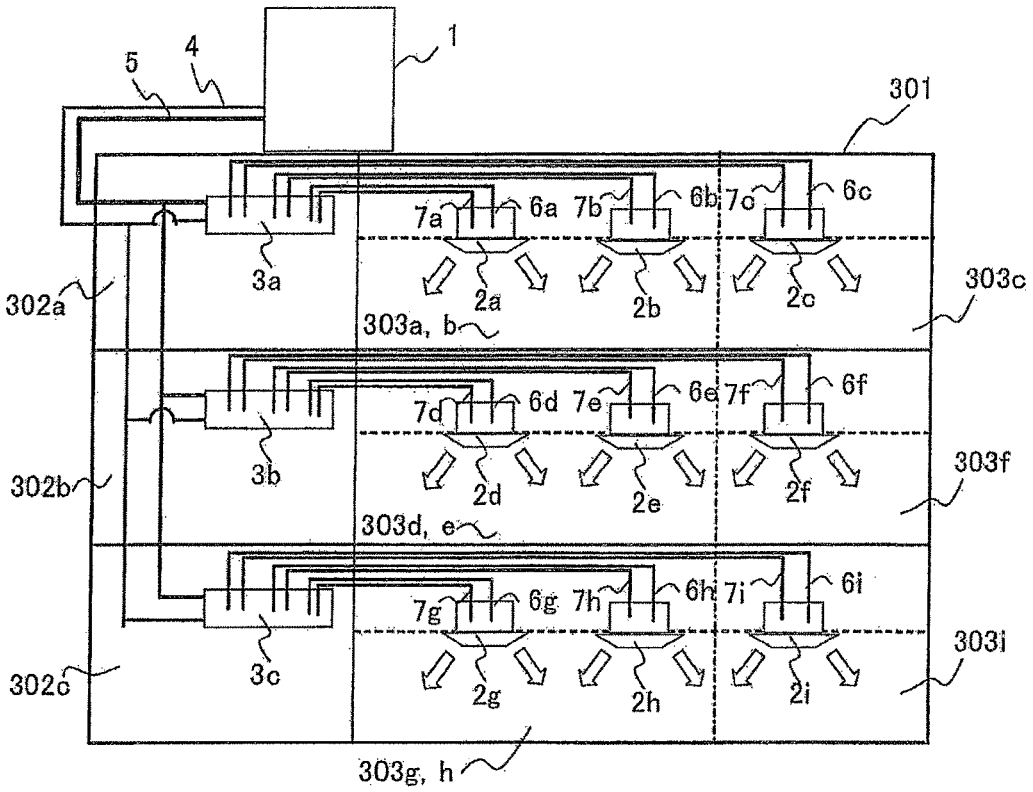
FIG. 2 is a diagram illustrating a manner of installing the air-conditioning apparatus according to Embodiment of the invention in a building or the like, FIG. 3 is a flowchart illustrating a method of controlling a heat medium flaw control device in the air-conditioning apparatus according to Embodiment of the invention.

FIG. 2 illustrates a manner of installing the air-conditioning apparatus according to Embodiment of the invention in a building or the like. The heat source unit 1 is disposed in a space outside a structure 301, such as a building. In the structure 301, the indoor units 2*a*, 2*b*, 2*c*, 2*d*, 2*e*, 2*f*, 2*g*, 2*h*, and 2*i* are arranged at respective positions where the air in indoor spaces 303*a*, 303*b*, 303*c*, 303*d*, 303*e*, 303*f*, 303*g*, 303*h*, and 303*i*, serving as air-conditioning target spaces in the structure 301, for example, living rooms, can be heated or cooled. The relay units 3*a*, 3*b*, and 3*c* are arranged in non-air-conditioning target spaces 302*a*, 302*b*, and 302*c* in the structure which are different from the indoor spaces 303*a*, 303*b*, 303*c*, 303*d*, 303*e*, 303*f*, 303*g*, 303*h*, and 303*i*. Although the two relay units 3 are illustrated in FIG. 1 and the three relay units 3 are illustrated in FIG. 2, any number of relay units 3 may be arranged.

Operation Modes

Operations in operation modes of the air-conditioning apparatus according to Embodiment will now be described on the basis of flows of the refrigerant and the heat medium illustrated in FIG. 1. In FIG. 1, solid-line arrows indicate a flow direction of the refrigerant during the heating operation, broken-line arrows indicate a flow direction of the refrigerant during the cooling operation, and alternate-long-and-short-dash-line arrows indicate a flow direction of the heat medium during the cooling and heating operations. In this case, it is assumed that the level of a pressure in the refrigeration cycle or the like is not determined in relation to a reference pressure and a relative pressure obtained by, for example, compression through the compressor 11, refrigerant flow rate control through the expansion devices 32*a* and 32*b*, and the like is expressed as a high or low pressure. The same applies to the level of a temperature.

Heating Operation

The heating operation in which the indoor units 2*a*, 2*b*, 2*c*, 2*d*, 2*e*, and 2*f* heat the indoor spaces 303*a*, 303*b*, 303*c*, 303*d*, 303*e*, and 303*f* will now be described. First, the flow of the refrigerant in the refrigeration cycle will be described. In the heat source unit 1, the refrigerant sucked in the compressor 11 is compressed into a high-pressure gas refrigerant and the resultant refrigerant is discharged. The refrigerant discharged from the compressor 11 flows through the four-way valve 12, passes through the gas pipes 4, and flows into the relay units 3.

The gas refrigerant, which has flowed into the relay units 3*a* and 3*b*, flows into the intermediate heat exchangers 31*a* and 31*b*. Since the intermediate heat exchangers 31*a* and 31*b* each function as a condenser for the refrigerant (i.e., operate as a condenser in the refrigeration cycle), the refrigerant passing through the intermediate heat exchangers 31*a* and 31*b* heats the heat medium (or transfers heat to the heat medium) with which the refrigerant exchanges heat, such that the refrigerant liquefies. The liquid refrigerant which has flowed out of the intermediate heat exchangers 31*a* and 31*b* is depressurized by the expansion devices 32*a* and 32*b*, such that the refrigerant is turned into a low-temperature low-pressure two-phase gas-liquid refrigerant. The low-temperature low-pressure refrigerant passes through the liquid pipes 5 and flows out of the relay units 3*a* and 3*b*.

The refrigerant flows into the heat source unit 1 and then flows into the heat source side heat exchanger 13, in which the refrigerant exchanges heat with the air such that the refrigerant evaporates and turns into a gas refrigerant or a two-phase gas-liquid refrigerant. The resultant refrigerant flows out of the heat source side heat exchanger 13 and passes through the four-way valve 12 and the accumulator 14 and is then again sucked into the compressor 11.

Then, the flows of the heat medium in the heat medium circuits will be described. The heat medium is heated by heat exchange with the refrigerant in the intermediate heat exchangers 31*a* and 31*b*. The heat medium heated in the intermediate heat exchangers 31*a* and 31*b* is sucked into the pumps 41*a* and 41*b* and is then directed to the first heat medium passages 50*a* and 50*b*. In the heat medium dividing portion 55*a*, the heat medium is divided into flows to the heat medium supply passages 6*a*, 6*b*, and 6*c*. The heat medium flows leaving the relay unit 3*a* enter the respective indoor units 2*a*, 2*b*, and 2*c*. In the heat medium dividing portion 55*b*, the heat medium is divided into flows to the heat medium supply passages 6*d*, 6*e*, and 6*f*. The heat medium flows leave the relay unit 3*b* and enter the respective indoor units 2*d*, 2*e*, and 2*f*.

The heat medium which has entered the indoor units 2*a*, 2*b*, 2*c*, 2*d*, 2*e*, and 2*f* exchanges heat with the air sent by fans 102*a*, 102*b*, 102*c*, 102*d*, 102*e*, and 102*f* in the use side heat exchangers 35*a*, 35*b*, 35*c*, 35*d*, 35*e*, and 35*f* to heat the air, such that the heat medium decreases in temperature (or transfers heat to the air). Thus, the indoor spaces 303*a*, 303*b*, 303*c*, 303*d*, 303*e*, and 303*f* are heated.

The heat medium flows, which have left the indoor units 2*a*, 2*b*, and 2*c*, pass through the heat medium return passages 7*a*, 7*b*, and 7*c* and the heat medium flow control devices 45*a*, 45*b*, and 45*c* and are then combined together in the heat medium combining portion 56*a*. The heat medium flows, which have left the indoor units 2*d*, 2*e*, and 2*f*, pass through the heat medium return passages 7*d*, 7*e*, and 7*f* and the heat medium flow control devices 45*d*, 45*e*, and 45*f* and are then combined together in the heat medium combining portion 56*b*. After that, the heat medium passes through the second heat medium passages 51*a* and 51*b* and then enters the intermediate heat exchangers 31*a* and 31*b*.

Cooling Operation

The cooling operation in which the indoor units 2*a*, 2*b*, 2*c*, 2*d*, 2*e*, and 2*f* cool the indoor spaces 303*a*, 303*b*, 303*c*, 303*d*, 303*e*, and 303*f* will now be described. First, the flow of the refrigerant in the refrigeration cycle will be described. In the heat source unit 1, the refrigerant sucked in the compressor 11 is compressed into a high-pressure gas refrigerant and the resultant refrigerant is discharged. The refrigerant discharged from the compressor 11 passes through the four-way valve 12 and enters the heat source side heat exchanger 13, functioning as a condenser. While passing through the heat source side heat exchanger 13, the high-pressure gas refrigerant exchanges heat with the outside air blown by the fan 101 such that the refrigerant condenses into a high-pressure liquid refrigerant. The resultant refrigerant flows out of the heat source side heat exchanger 13, passes through the liquid pipes 5, and flows into the relay units 3*a* and 3*b*.

The refrigerant which has flowed into the relay units 3*a* and 3*b* is expanded into a low-temperature low-pressure two-phase gas-liquid refrigerant by the expansion devices 32*a* and 32*b* each having an opening degree controlled. The resultant refrigerant flows into the intermediate heat exchangers 31*a* and 31*b*. Since the intermediate heat exchangers 31*a* and 31*b* each function as an evaporator for the refrigerant (i.e., operate as an evaporator in the refrigeration cycle), the refrigerant passing through the intermediate heat exchangers 31*a* and 31*b* cools the heat medium (or removes heat from the heat medium) with which the refrigerant exchanges heat such that the refrigerant turns into a gas refrigerant, and then flows out of the intermediate heat exchangers 31*a* and 31*b*. The gas refrigerant then passes through the gas pipes 4 and flows out of the relay units 3*a* and 3*b*. The refrigerant flows into the heat source unit 1, passes through the four-way valve 12 and the accumulator 14, and is then again sucked into the compressor 11.

Then, the flows of the heat medium in the heat medium circuits will be described. The heat medium is cooled by heat exchange with the refrigerant in the intermediate heat exchangers 31*a* and 31*b*. The heat medium cooled in the intermediate heat exchangers 31*a* and 31*b* is sucked into the pumps 41*a* and 41*b* and is then directed to the first heat medium passages 50*a* and 50*b*. In the heat medium dividing portion 55*a*, the heat medium is divided into flows to the heat medium supply passages 6*a*, 6*b*, and 6*c*. The heat medium flows leave the relay unit 3*a* and enter the respective indoor units 2*a*, 2*b*, and 2*c*. In the heat medium dividing portion 55*b*, the heat medium is divided into flows to the heat medium supply passages 6*d*, 6*e*, and 6*f*. The heat medium flows leave the relay unit 3*b* and enter the respective indoor units 2*d*, 2*e*, and 2*f*.

The heat medium, which has entered the indoor units 2*a*, 2*b*, 2*c*, 2*d*, 2*e*, and 2*f*, exchanges heat with the air sent by the fans 102*a*, 102*b*, 102*c*, 102*d*, 102*e*, and 102*f* in the use side heat exchangers 35*a*, 35*b*, 35*c*, 35*d*, 35*e*, and 35*f* to cool the air, such that the heat medium increases in temperature (or removes heat from the air). Thus, the indoor spaces 303*a*, 303*b*, 303*c*, 303*d*, 303*e*, and 303*f* are cooled.

The heat medium flows, which have left the indoor units 2*a*, 2*b*, and 2*c*, pass through the heat medium return passages 7*a*, 7*b*, and 7*c* and the heat medium flow control devices 45*a*, 45*b*, and 45*c* and are then combined together in the heat medium combining portion 56*a*. The heat medium flows, which have left the indoor units 2*d*, 2*e*, and 2*f*, pass through the heat medium return passages 7*d*, 7*e*, and 7*f* and the heat medium flow control devices 45*d*, 45*e*, and 45*f* and are then combined together in the heat medium combining portion 56*b*. After that, the heat medium passes through the second heat medium passages 51*a* and 51*b* and enters the intermediate heat exchangers 31*a* and 31*b*.

Control for Actuators in Refrigeration Cycle

During each of the above-described heating and cooling operations, the actuators arranged in the refrigeration cycle are controlled as follows.

The rotation speed of the compressor 11 is controlled by the controller 201. Specifically, during the heating operation, the controller 201 controls the rotation speed of the compressor 11 such that a discharge pressure detected by the pressure sensor 71 reaches a target value, thus controlling the flow rate of the refrigerant in the refrigeration cycle. In this case, it is preferred that the discharge pressure be converted to a saturation pressure and the saturation pressure be approximately 50 degrees C. During the cooling operation, the controller 201 controls the rotation speed of the compressor 11 such that a suction pressure detected by the pressure sensor 72 reaches a target value, thus controlling the flow rate of the refrigerant in the refrigeration cycle. In this case, it is preferred that the suction pressure be converted to a saturation pressure and the saturation pressure be approximately 0 degrees C.

The opening degrees of the expansion devices 32*a* and 32*b* are controlled by the controllers 202*a* and 202*b*, respectively. Specifically, during the heating operation, each of the controllers 202*a* and 202*b* converts a condensing pressure detected by the corresponding one of the pressure sensors 73*a* and 73*b* to a saturation temperature. Each of the controllers 202*a* and 202*b* controls the opening degree of the corresponding one of the expansion devices 32*a* and 32*b* such that the difference (i.e., the degree of subcooling) between the saturation temperature and a refrigerant outlet temperature of the corresponding one of the intermediate heat exchangers 31*a* and 31*b* detected by the corresponding one of the temperature sensors 75*a* and 75*b* reaches a predetermined target value, thus controlling the flow rate of the refrigerant flowing into the corresponding one of the intermediate heat exchangers 31*a* and 31*b*. In this case, the degree of subcooling is preferably approximately in the range of 3 to 8 degrees C. During the cooling operation, each of the controllers 202*a* and 202*b* controls the opening degree of the corresponding one of the expansion devices 32*a* and 32*b* such that the difference (i.e., the degree of superheat) between an outlet temperature of the corresponding one of the intermediate heat exchangers 31*a* and 31*b* detected by the corresponding one of the temperature sensors 74*a* and 74*b* and an inlet temperature thereof detected by the corresponding one of the temperature sensors 75*a* and 75*b* reaches a predetermined target value, thus controlling the flow rate of the refrigerant flowing into the corresponding one of the intermediate heat exchangers 31*a* and 31*b*. In this case, the degree of superheat is preferably approximately in the range of 2 to 5 degrees C.

Heat Medium Flow Rate Control for Heat Medium Row Control Devices

During each of the above-described heating and cooling operations, the controllers 202*a* and 202*b* controls the opening degrees of the heat medium flow control devices 45*a*, 45*b*, 45*c*, 45*d*, 45*e*, and 45*f* such that a heat medium temperature difference ΔTw (=Twi−Two) between a heat medium inlet temperature Twi of each of the use side heat exchangers 35*a*, 35*b*, 35*c*, 35*d*, 35*e*, and 35*f* and a heat medium outlet temperature Two thereof reaches a target heat medium temperature difference ΔTwm. The control for the heat medium flow control devices 45 will be described below with reference to FIG. 3. Since the heat medium flow control devices 45 are controlled by the same method, the control for the heat medium flow control device 45*a* will be described as an example with reference to FIG. 3. According to Embodiment, to reduce the frequency of controlling the heat medium flow control device 45, the target heat medium temperature difference ΔTwm is allowed to have a given range, serving as a stable range. Accordingly, the method of controlling the opening degree of the heat medium flow control device 45*a* such that the heat medium temperature difference ΔTw of the use side heat exchanger 35*a* reaches the target heat medium temperature difference ΔTwm having a predetermined range will be described with reference to FIG. 3.

Figure 3:
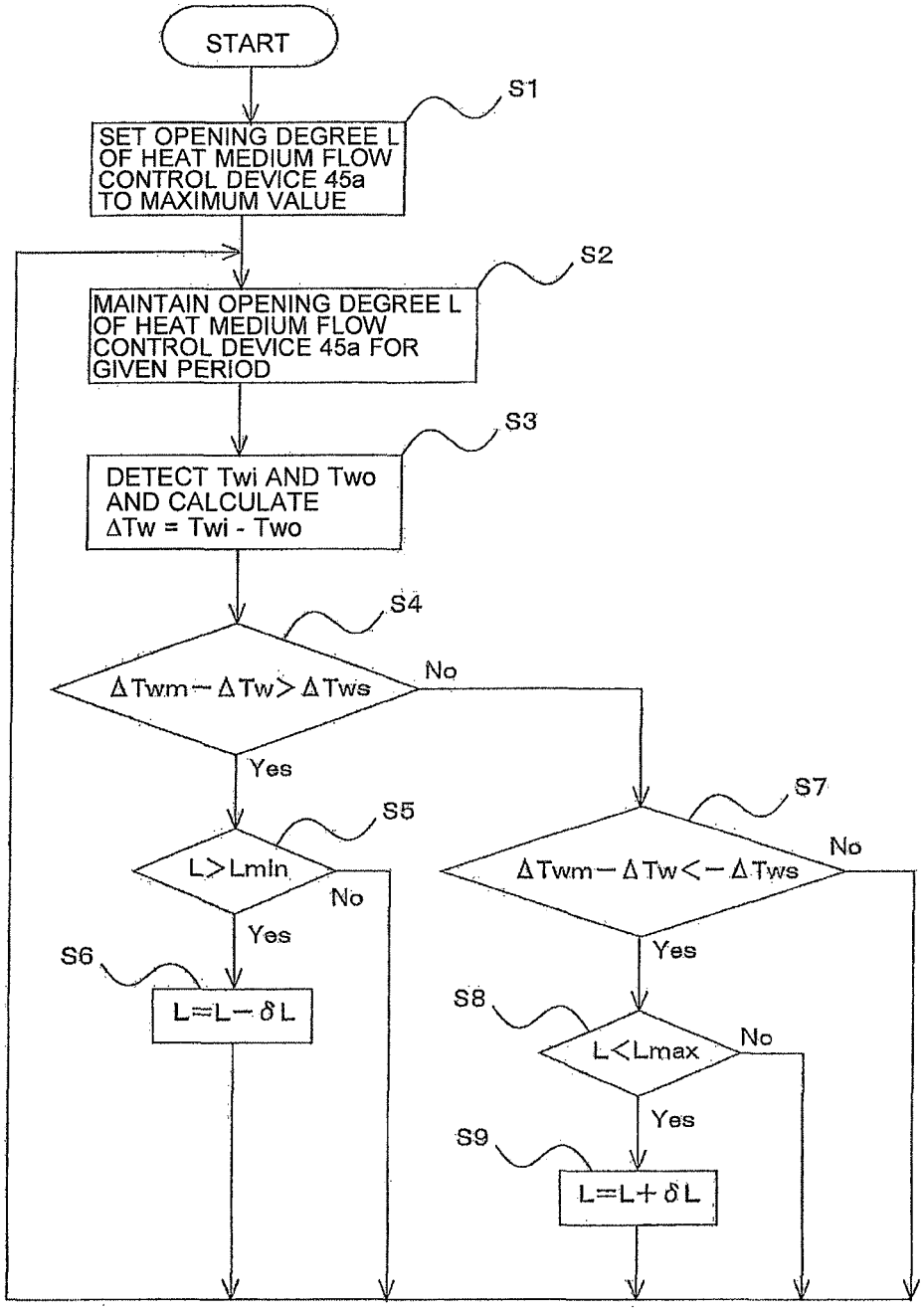

FIG. 3 is a flowchart illustrating the method of controlling the heat medium flow control device in the air-conditioning apparatus according to Embodiment of the invention.

Referring to FIG. 3, in step S1, the controller 202*a* sets the opening degree, L, of the heat medium flow control device 45*a* to a maximum value.

In step S2, the controller 202*a* maintains the opening degree L of the heat medium flow control device 45*a* for a given period of time. In step S3, the controller 202*a* allows the temperature sensor 81*a* to detect the heat medium inlet temperature Twi of the use side heat exchanger 35*a* and allows the temperature sensor 85*a* to detect the heat medium outlet temperature Two of the use side heat exchanger 35*a*. The controller 202*a* calculates the heat medium temperature difference ΔTw of the use side heat exchanger 35*a* on the basis of these values Twi and Two.

In step S4, the controller 202*a* determines whether a value obtained by subtracting the heat medium temperature difference ΔTw from the target heat medium temperature difference ΔTwm is greater than an upper limit ΔTws of the target heat medium temperature difference ΔTwm (stable range). If the value obtained by subtracting the heat medium temperature difference ΔTw from the target heat medium temperature difference ΔTwm is greater than ΔTws, the controller 202*a* determines that the heat medium temperature difference ΔTw is less than the target heat medium temperature difference ΔTwm (Yes), and then proceeds to step S5. In step S5, the controller 202*a* determines whether the opening degree L of the heat medium flow control device 45*a* is greater than a minimum opening degree Lmin. If the opening degree L of the heat medium flow control device 45*a* is greater than the minimum opening degree Lmin, the controller 202*a* reduces the opening degree L of the heat medium flow control device 45*a* by an amount of δL in step S6 to reduce the flow rate of the heat medium, and then returns to step S2. If the opening degree L of the heat medium flow control device 45*a* is less than or equal to the minimum opening degree Lmin in step S5, the controller 202*a* returns to step S2 without changing the opening degree L.

On the other hand, if the value obtained by subtracting the heat medium temperature difference ΔTw from the target heat medium temperature difference ΔTwm is less than or equal to the upper limit ΔTws of the target heat medium temperature difference ΔTwm (stable range) in step S4, the controller 202*a* proceeds to step S7. In step S7, the controller 202*a* determines whether the value obtained by subtracting the heat medium temperature difference ΔTw from the target heat medium temperature difference ΔTwm is less than a lower limit −ΔTws of the target heat medium temperature difference ΔTwm (stable range). If the value obtained by subtracting the heat medium temperature difference ΔTw from the target heat medium temperature difference ΔTwm is less than the lower limit −ΔTws, the controller 202*a* determines that the heat medium temperature difference ΔTw is greater than the target heat medium temperature difference ΔTwm (Yes), and proceeds to step S8. If the value obtained by subtracting the heat medium temperature difference ΔTw from the target heat medium temperature difference ΔTwm is greater than or equal to the lower limit −ΔTws in step S7, the controller 202*a* determines that the heat medium temperature difference ΔTw of the use side heat exchanger 35*a* is within the stable range, and then returns to step S2.

In step S8, the controller 202*a* determines whether the opening degree L of the heat medium flow control device 45*a* is less than a maximum opening degree Lmax. If the opening degree L of the heat medium flow control device 45*a* is less than the maximum opening degree Lmax, the controller 202*a* increases the opening degree L of the heat medium flow control device 45*a* by the amount of δL in step S9 to increase the flow rate of the heat medium, and then returns to step S2. If the opening degree L of the heat medium flow control device 45*a* is greater than or equal to the maximum opening degree Lmax in step S8, the controller 202*a* returns to step S2 without changing the opening degree L.

In the heat medium flow rate control for each of the use side heat exchangers 35*b* and 35*c*, the temperature of the heat medium detected by the temperature sensor 81*a* is used as the heat medium inlet temperature Twi and the temperature of the heat medium detected by the corresponding one of the temperature sensors 85*b* and 85*c* is used as the heat medium outlet temperature Two. Furthermore, in the heat medium flow rate control for each of the use side heat exchangers 35*d*, 35*e*, and 35*f*, the temperature of the heat medium detected by the temperature sensor 81*b* is used as the heat medium inlet temperature Twi and the temperature of the heat medium detected by the corresponding one of the temperature sensors 85*d*, 85*e*, and 85*f* is used as the heat medium outlet temperature Two.

The control illustrated with the flowchart of FIG. 3 is started when the indoor unit 2*a* starts the heating operation. While the indoor unit 2*a* is stopped, the heat medium flow control device 45*a* has such an opening degree that the heat medium does not flow through the use side heat exchanger 35*a*.

In the control for the heat medium flow control device 45*a* in Embodiment, if the heat medium temperature difference ΔTw is less than the target heat medium temperature difference ΔTwm, it is determined that a heating load on the indoor unit 2*a* is reduced, and control of processing of steps S5 and S6 is then performed. The reason is as follows: An increase in the temperature of the air at an inlet of the indoor unit 2*a* leads to a reduction in the temperature difference between the heat medium and the air in the use side heat exchanger 35*a*, resulting in a reduction in the amount of heat exchange. This causes a reduction in the heat medium temperature difference ΔTw. The controller 202*a* therefore reduces the opening degree of the heat medium flow control device 45*a* to reduce the flow rate of the heat medium flowing into the use side heat exchanger 35*a*. In addition, if the heat medium temperature difference ΔTw is greater than the target heat medium temperature difference ΔTwm, it is determined that the heating load on the indoor unit 2*a* is increased, and control process of steps S8 and S9 is then performed. The reason is as follows: A reduction in the temperature of the air at the inlet of the indoor unit 2*a* leads to an increase in the temperature difference between the heat medium and the air in the use side heat exchanger 35*a*, resulting in an increase in the amount of heat exchange. This causes an increase in the heat medium temperature difference ΔTw. The controller 202*a* therefore increases the opening degree of the heat medium flow control device 45*a* to increase the flow rate of the heat medium flowing into the use side heat exchanger 35*a*.

Specifically, since the air-conditioning apparatus according to Embodiment controls the heat medium flow control device 45 corresponding to each use side heat exchanger 35 such that the heat medium temperature difference ΔTw of the use side heat exchanger 35 approaches the target heat medium temperature difference ΔTwm, the flow rate of the heat medium can be controlled in accordance with a heating load on the use side heat exchanger 35 (or the indoor unit 2).

In addition, since the heat medium temperature difference ΔTw of the use side heat exchanger 35 is controlled by the heat medium flow control device 45 for each indoor unit 2, the flow rate of the heat medium can be controlled depending on a heating load for each air-conditioning target space if the indoor units 2 are arranged in different air-conditioning target spaces. For example, referring to FIG. 2, the indoor units 2*a* and 2*b* are arranged in the indoor spaces 303*a* and 303*b* which communicate with each other. Accordingly, the indoor units 2*a* and 2*b* condition the air in the same air-conditioning target space. The indoor unit 2*c* is disposed in the indoor space 303*c* which is separated from the indoor spaces 303*a* and 303*b* and accordingly conditions the air in an air-conditioning target space different from those conditioned by the indoor units 2*a* and 2*b*. In this case, the air-conditioning apparatus according to Embodiment allows the heat medium to flow through the use side heat exchanger 35 of the indoor unit 2 disposed in each air-conditioning target space such that the flow rate of the heat medium depends on a heating load for the air-conditioning target space.

According to Embodiment, if it is determined in step S5 that the opening degree L of the heat medium flow control device 45 is less than or equal to the minimum opening degree Lmin, the opening degree L is not reduced any more. This prevents the heat medium flow control device 45 from having too small an opening degree which would lead to blockage of the heat medium flow.

Control for Changing Target Heat Medium Temperature Difference ΔTwm

Control for changing the target heat medium temperature difference ΔTwm will now be described below. This control is one of features of the air-conditioning apparatus according to Embodiment.

According to the foregoing control method, if the heat medium inlet temperature Twi of the use side heat exchanger 35 is a given temperature, the heat medium temperature difference ΔTw is allowed to reach the target heat medium temperature difference ΔTwm in order to control the flow rate of the heat medium, thus controlling heating capacity depending on a heating load (the temperature of the air at the inlet) of the indoor unit 2*a*. However, a change in the number of operating indoor units 2 (use side heat exchangers 35) of the indoor units connected to the intermediate heat exchanger 31 leads to a change in the heat medium inlet temperature Twi. Because the heat medium inlet temperature Twi detected by the temperature sensor 81 is the temperature of the heat medium flowing out of the intermediate heat exchanger 31 (that is, the heat medium which serves as a combination of the heat medium flows leaving the use side heat exchangers 35 and which has been subjected to heat exchange in the intermediate heat exchanger 31) as well as being the temperature of the heat medium flowing into the use side heat exchangers 35. Accordingly, in the case where the number of operating indoor units 2 connected to the intermediate heat exchanger 31 changes (that is, an air conditioning load on the intermediate heat exchanger 31 changes), it is difficult to control air conditioning capacity of each indoor unit 2 by merely controlling the heat medium temperature difference ΔTw to a given value. According to Embodiment, therefore, the target heat medium temperature difference ΔTwm is controlled so as to be changed in order to suitably control the air conditioning capacity of each indoor unit 2 even when the number of operating indoor units 2 connected to the intermediate heat exchanger 31 changes (that is, the air conditioning load on the intermediate heat exchanger 31 changes).

A detailed description will be made about a problem that would occur when the number of operating indoor units 2 connected to the intermediate heat exchanger 31 changes (that is, the air-conditioning load on the intermediate heat exchanger 31 changes) and the control for changing the target heat medium temperature difference ΔTwm which is very effective in solving the problem. In the following description, the heat medium circuit in which the intermediate heat exchanger 31*a* is connected will be described as an example.

During the heating operation, a temperature efficiency ratio ε for the heat medium of the intermediate heat exchanger 31*a* is expressed by Equation (1).

$$\varepsilon=(Twi-\mathrm{Two})/(T\mathrm{cond}-\mathrm{Two}) \quad (1)$$

In Equation (1), Tcond denotes the condensing temperature of the refrigerant flowing through the intermediate heat exchanger 31*a*. The condensing temperature Tcond is controlled to be a given value on the basis of the rotation speed of the compressor 11. To match the relationship between the inlet and the outlet to that of the use side heat exchanger 35*a*, Two denotes a heat medium outlet temperature of the intermediate heat exchanger 31*a* and Twi denotes a heat medium inlet temperature thereof in Equation (1).

Furthermore, the number of heat transfer units Ntu is expressed by Equation (2).

$$Ntu=Ap\cdot Kp/\Sigma Gw\cdot Cp \quad (2)$$

In Equation (2), Ap denotes the heat transfer area of the intermediate heat exchanger 31*a*, Kp denotes the coefficient of overall heat transfer of the intermediate heat exchanger 31*a*, Cp denotes the specific heat at constant pressure of the heat medium, and ΣGw denotes the heat medium mass flow rate of the intermediate heat exchanger 31*a*, the mass flow rate being the sum of mass flow rates Gwa, Gwb, and Gwc of the use side heat exchangers 35*a*, 35*b*, and 35*c*. The values Ap, Kp, and Cp are assumed to be substantially constant.

Furthermore, the relationship between Equations (1) and (2) is expressed by Equation (3).

$$\varepsilon=1-\exp(-Ntu) \quad (3)$$

Equation (3) demonstrates that as the number of heat transfer units Ntu increases, the temperature efficiency ratio ε approaches 1.

A change in the temperature of the heat medium upon change in the number of operating indoor units 2 (use side heat exchangers 35) will now be described. In the following description, a state in which all of the three indoor units 2*a*, 2*b*, and 2*c* connected to the intermediate heat exchanger 31*a* (relay unit 3*a*) perform the heating operation will be referred to as a "three-unit operation" and a state in which only the indoor unit 2*a* performs the heating operation and the indoor units 2*b* and 2*c* are stopped will be referred to as a "single-unit operation". It is assumed that the indoor units 2*a*, 2*b*, and 2*c* are subject to substantially the same heating load. A change in the heat medium temperature during the single-unit operation will be described below in comparison with that during the three-unit operation.

During the single-unit operation, the heat medium mass flow rate ΣGw of the intermediate heat exchanger 31*a* is ΣGw=Gwa which is approximately ⅓ of that during the three-unit operation. It can be seen using Equation (2) that the number of heat transfer units Ntu increases. Additionally, it can be seen using Equation (3) that the temperature efficiency ratio ε increases.

Considering the temperature of the heat medium, since the heat medium temperature difference ΔTw (=Twi−Two) is controlled to be a given value by the above-described heat medium flow rate control for the heat medium flow control device 45, the increase of the temperature efficiency ratio c means an increase in Two as will be seen from Equation (1). Since the heat medium temperature difference ΔTw (=Twi−Two) is controlled to be a given value, the value Twi also increases at the same time.

Figure 4:
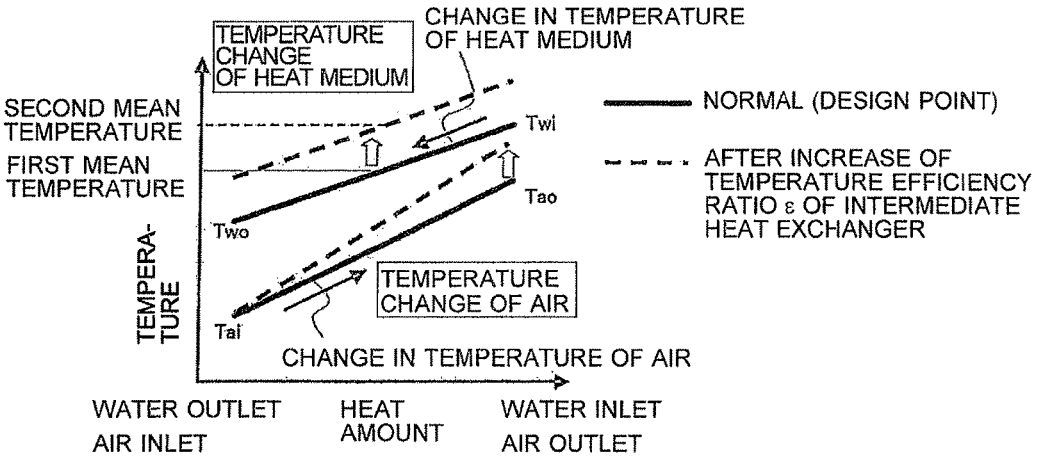
FIG. 4 is a characteristic diagram illustrating changes in temperature of air and a heat medium flowing through a use side heat exchanger in the air-conditioning apparatus according to Embodiment of the invention upon change in the number of operating indoor units during control of a heat medium temperature difference $\Delta Tw$ to a given value.

On the other hand, when the three-unit operation is switched to the single-unit operation, the heat medium and the air flowing through the use side heat exchanger 35*a* change as illustrated in FIG. 4.

FIG. 4 is a characteristic diagram illustrating changes in temperature of the air and the heat medium flowing through the use side heat exchanger upon change of the number of operating indoor units while the heat medium temperature difference ΔTw is controlled to be a given value in the air-conditioning apparatus according to Embodiment of the invention. FIG. 4 illustrates the temperature plotted along the axis of ordinates against the amount of heat plotted along the axis of abscissa. In FIG. 4, solid lines (referred to as "normal" in FIG. 4) denote the temperatures of the air and the heat medium flowing through the use side heat exchanger 35*a* during the three-unit operation. In addition, broken lines denote the temperatures of the air and the heat medium flowing through the use side heat exchanger 35*a* during the single-unit operation, that is, the temperatures of the air and the heat medium flowing through the use side heat exchanger 35*a* after the increase of the temperature efficiency ratio ε of the intermediate heat exchanger 31*a*.

In the use side heat exchanger 35*a*, the heat medium exchanges heat with the air in a counter-current manner. In this case, the heat medium transfers heat to the air, so that the temperature of the heat medium falls from the heat medium inlet temperature Twi to the heat medium outlet temperature Two. On the other hand, the air removes heat from the heat medium, so that the temperature of the air rises from an air inlet temperature Tai to an air outlet temperature Tao.

The amount of heat exchange Qa in the use side heat exchanger 35*a* at that time can be obtained using Equation (4) on the basis of the difference in temperature between the heat medium and the air flowing through the use side heat exchanger 35*a*.

$$Qa=Af\cdot Kf\cdot \Delta Twa \tag{4}$$

In Equation (4), Af denotes the heat transfer area of the use side heat exchanger 35*a*, Kf denotes the coefficient of overall heat transfer of the use side heat exchanger 35*a*, and ΔTwa denotes the temperature difference between the heat medium and the air flowing through the use side heat exchanger 35*a*.

As described above, since the temperature efficiency ratio of the intermediate heat exchanger 31*a* increases upon switching from the three-unit operation to the single-unit operation, the heat medium inlet temperature Twi and the heat medium outlet temperature Two rise as shown in FIG. 4, so that the mean temperature of the heat medium flowing through the use side heat exchanger 35*a* increases from a first mean temperature to a second mean temperature. Consequently, the temperature difference ΔTwa between the heat medium and the air flowing through the use side heat exchanger 35*a* increases. It is seen using Equation (4) that the heat exchange amount Qa of the use side heat exchanger 35*a* is increased.

In other words, so long as the flow rate of the air flowing through the use side heat exchanger 35*a* and the air inlet temperature Tai are constant, the air outlet temperature Tao rises with increasing the heat exchange amount Qa of the use side heat exchanger 35*a*.

The above description can be summarized as follows: A decrease in the number of indoor units 2, connected to the intermediate heat exchanger 31*a*, and performing the heating operation causes the heat medium inlet temperature Twi and the heat medium outlet temperature Two of the use side heat exchanger 35*a* to rise, thus increasing the heat exchange amount Qa of the use side heat exchanger 35*a*, that is, the heat exchange amount Qa per use side heat exchanger. In other words, the heating capacity per indoor unit 2 increases. Unfortunately, an excess of heating capacity results in an increase in the air outlet temperature of the use side heat exchanger 35*a* (i.e., the temperature of air blown from the indoor unit 2). This would make a user feel uncomfortable. Additionally, this would lead to a repetition of operation and stop, thus causing start-stop loss of the air-conditioning apparatus.

To overcome the above-described disadvantages, an increase in the heating capacity of the indoor unit 2 has to be suppressed.

As regards a method of suppressing an increase in the heating capacity of the indoor unit 2, the heat medium inlet temperature Twi of the use side heat exchanger 35*a* may be controlled to be a given value. Furthermore, reducing the rotation speed of the compressor 11 in the heat source unit 1 so as to reduce the condensing temperature Tcond of the refrigerant flowing through the intermediate heat exchanger 31*a* is effective in controlling the heat medium inlet temperature of the use side heat exchanger 35*a* to be a given value. In an air-conditioning apparatus including a plurality of intermediate heat exchangers 31 (relay units 3) like the air-conditioning apparatus according to Embodiment, the indoor unit 2*a* may perform the heating operation in the heat medium circuit connected to the intermediate heat exchanger 31*a* (relay unit 3*a*) and the indoor units 2*d*, 2*e*, and 2*f* may perform the heating operation in the heat medium circuit connected to the intermediate heat exchanger 31*b* (relay unit 3*b*) in some cases. In an air-conditioning apparatus including a plurality of intermediate heat exchangers 31 (relay units 3) like the air-conditioning apparatus according to Embodiment, the number of operating indoor units in the heat medium circuit connected to the intermediate heat exchanger 31*a* (relay unit 3*a*) may be equal to that in the heat medium circuit connected to the intermediate heat exchanger 31*b* (relay unit 3*b*) but the indoor units in operation may have different capacities in some cases. In such a case, since the temperature efficiency ratio ε of the intermediate heat exchanger 31*a* differs from that of the intermediate heat exchanger 31*b*, it is difficult to set the condensing temperature Tcond.

In the air-conditioning apparatus according to Embodiment, therefore, when the heat medium inlet temperature of the use side heat exchanger 35*a* rises, the target heat medium temperature difference ΔTwm is increased to increase the heat medium temperature difference ΔTw, thus controlling the heating capacity of the indoor unit 2*a*. The heating capacity control will be described with reference to a flowchart of FIG. 5.

Figure 5:
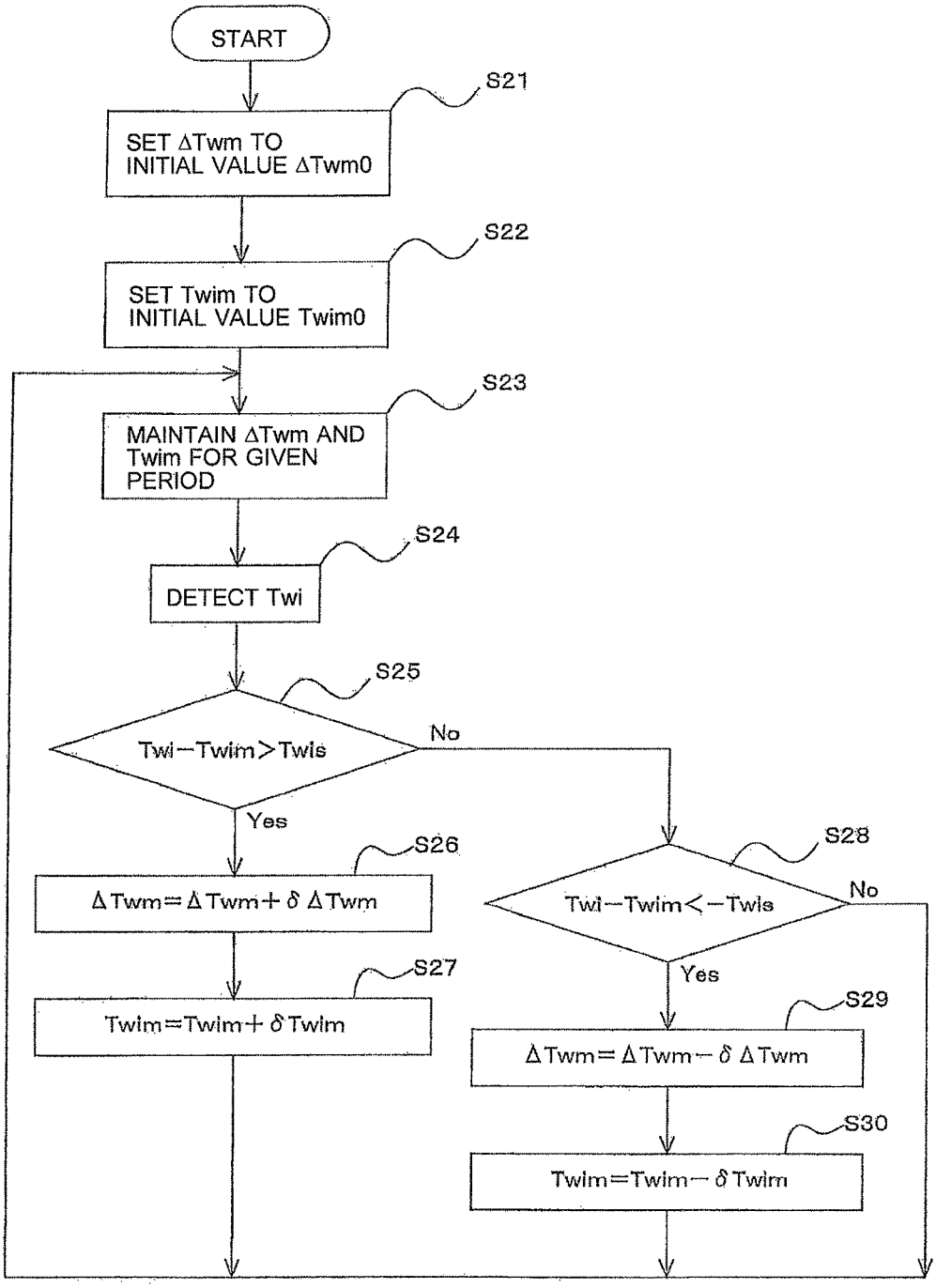
FIG. 5 is a flowchart illustrating a control method of changing a target heat medium temperature difference in the air-conditioning apparatus according to Embodiment of the invention.

FIG. 5 is the flowchart illustrating a control method for changing the target heat medium temperature difference in the air-conditioning apparatus according to Embodiment of the invention.

Referring to FIG. 5, in step S21, the controller 202*a* sets the target heat medium temperature difference ΔTwm to an initial value ΔTwm0 of the target heat medium temperature difference. In step S22, the controller 202*a* sets a heat medium inlet temperature set value Twim of the use side heat exchanger 35*a* to an initial value Twim0 of the heat medium inlet temperature set value.

In step S23, the controller 202*a* performs the heating operation while maintaining the target heat medium temperature difference ΔTwm and the heat medium inlet temperature set value Twim of the use side heat exchanger 35*a* at their initial values for a given period of time.

In step S24, the controller 202*a* allows the heat medium inlet temperature Twi of the use side heat exchanger 35*a* to be detected. As described above, the heat medium inlet temperature Twi is the heat medium outlet temperature of the intermediate heat exchanger 31*a* and is detected by the temperature sensor 81*a*.

In step S25, the controller 202*a* subtracts the heat medium inlet temperature set value Twim from the heat medium inlet temperature Twi and determines whether the obtained value is greater than an upper limit Twis of a stable range. In other words, the controller 202*a* determines whether the heat medium inlet temperature Twi is higher than an upper limit (Twis+Twim) of a predetermined range. If (Twi−Twin) is greater than the upper limit Twis of the stable range, the controller 202*a* proceeds to step S26 and increases the target heat medium temperature difference ΔTwm by an amount of δΔTwm. Furthermore, the controller 202*a* proceeds to step S27 and increases the heat medium inlet temperature set value Twim by an amount of δTwim and then returns to step S23.

On the other hand, if (Twi−Twim) is less than or equal to the upper limit Twis of the stable range in step S25, the controller 202*a* proceeds to step S28 and determines whether (Twi−Twim) is less than a lower limit −Twis of the stable range. In other words, the controller 202*a* determines whether the heat medium inlet temperature Twi is lower than a lower limit (−Twis+Twim) of the predetermined range. If (Twi−Twim) is less than the lower limit −Twis of the stable range, the controller 202*a* proceeds to step S29 and reduces the target heat medium temperature difference ΔTwm by the amount of δΔTwm. Furthermore, the controller 202*a* proceeds to step S30 and reduces the heat medium inlet temperature set value Twim by the amount of δTwim and then returns to step S23.

On the other hand, if (Twi−Twim) is greater than or equal to the lower limit −Twis of the stable range in step S28, the controller 202*a* determines that the heat medium inlet temperature Twi is within the stable range and then returns to step S23.

The control illustrated in the flowchart of FIG. 5 is started when any of the indoor units 2*a*, 2*b*, and 2*c* connected to the intermediate heat exchanger 31*a* (relay unit 3*a*) starts the heating operation. The control is terminated when all of the indoor units 2*a*, 2*b*, and 2*c* connected to the intermediate heat exchanger 31*a* (relay unit 3*a*) are stopped. Furthermore, the control illustrated in the flowchart of FIG. 5 is performed independently for each of the heat medium circuits including the intermediate heat exchangers 31*a* and 31*b* (relay units 3*a* and 3*b*).

Advantages of the above-described control for changing the target heat medium temperature difference ΔTwm will be described with reference to FIG. 6.

Figure 6:
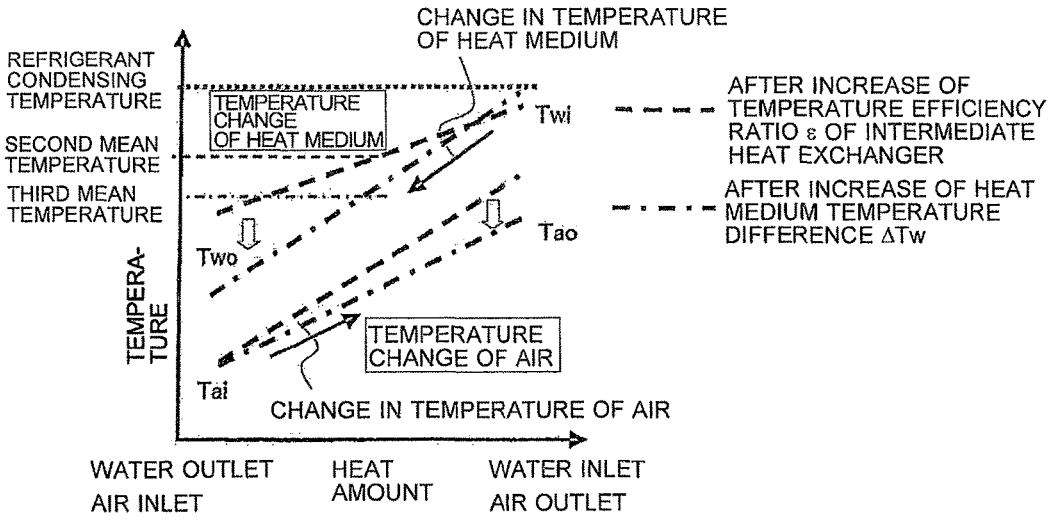
FIG. 6 is a characteristic diagram illustrating changes in temperature of the air and the heat medium flowing through the use side heat exchanger in the air-conditioning apparatus according to Embodiment of the invention upon control for changing a target heat medium temperature difference $\Delta Twm$.

FIG. 6 is a characteristic diagram illustrating changes in temperature of the air and the heat medium flowing through the use side heat exchanger after the control for changing the target heat medium temperature difference ΔTwm in the air-conditioning apparatus according to Embodiment of the invention. FIG. 6 illustrates temperature plotted along the axis of ordinates against the amount of heat plotted along the axis of abscissa. In FIG. 6, as also illustrated in FIG. 4, broken lines indicate the temperatures of the air and the heat medium flowing through the use side heat exchanger 35*a* after increase of the temperature efficiency ratio ε of the intermediate heat exchanger 31*a*. Alternate long and short dash lines indicate the temperatures of the air and the heat medium flowing through the use side heat exchanger 35*a* after control for increasing the target heat medium temperature difference ΔTwm. Specifically, FIG. 6 illustrates a comparison between the temperature changes of the heat medium and the air in the use side heat exchanger 35*a* after the increase of the temperature efficiency ratio of the intermediate heat exchanger 31*a*, which has been described above with reference to FIG. 4, and those in the use side heat exchanger 35*a* after the control for increasing the heat medium temperature difference ΔTw in Embodiment.

Referring to FIG. 6, the heat medium inlet temperature Twi of the use side heat exchanger 35*a* slightly rises with increasing the target heat medium temperature difference ΔTwm. The reason is as follows: When the target heat medium temperature difference ΔTwm is increased, the control for increasing the heat medium temperature difference ΔTw is performed (refer to FIG. 3), so that the opening degree L of the heat medium flow control device 45*a* is reduced to reduce the flow rate of the heat medium flowing through the intermediate heat exchanger 31*a*, thus further enhancing the temperature efficiency ratio ε of the intermediate heat exchanger 31*a*. However, the heat medium inlet temperature Twi of the use side heat exchanger 35*a* (or the heat medium outlet temperature of the intermediate heat exchanger 31*a*) does not exceed the condensing temperature Tcond. Furthermore, since the heat medium inlet temperature Twi of the use side heat exchanger 35*a* has a value close to the condensing temperature Tcond while the temperature efficiency ratio ε of the intermediate heat exchanger 31*a* is enhanced in advance, the extent to which the heat medium inlet temperature Twi rises due to the increase of the target heat medium temperature difference ΔTwm is small.

On the other hand, when the target heat medium temperature difference ΔTwm (or the target value of the heat medium temperature difference ΔTw (=Twi−Two)) is increased, the heat medium outlet temperature Two of the use side heat exchanger 35*a* falls, so that the mean temperature of the heat medium decreases from the second mean temperature to a third mean temperature. Consequently, the temperature difference ΔTwa between the heat medium and the air flowing through the use side heat exchanger 35*a* is reduced, so that the heat exchange amount Qa of the use side heat exchanger 35*a* is reduced as seen from Equation (4). The reduction of the heat exchange amount Qa leads to a reduction in the air outlet temperature Tao of the use side heat exchanger 35*a*, that is, the temperature of air blown from the indoor unit 2*a*.

In the air-conditioning apparatus with the configuration described in Embodiment, when the heat medium inlet temperature Twi of the use side heat exchanger 35*a* exceeds the predetermined range, the target heat medium temperature difference ΔTwm is increased, so that an excess of heating capacity can be avoided. Consequently, the air outlet temperature of the use side heat exchanger 35*a*, that is, the temperature of air blown from the indoor unit 2 can be prevented from excessively rising. Thus, comfort can be provided to the user and start-stop loss in the air-conditioning apparatus caused by a repetition of operation and stop can be reduced.

Furthermore, in the air-conditioning apparatus according to Embodiment, since the heating capacity of the use side heat exchanger 35*a* can be controlled without controlling the condensing temperature or the degree of subcooling of the refrigerant in the intermediate heat exchanger 31*a*, the operation can be performed while the efficiency of the refrigeration cycle on the heat source side is enhanced. In addition, the condensing temperature of the refrigerant does not have to be controlled in the air-conditioning apparatus according to Embodiment. Accordingly, in the arrangement in which the controller is provided for each of the heat source unit 1 and the relay units 3, a communication load on each of the controller 201 and the controller 202*a* can be reduced as compared with, for example, an air-conditioning apparatus in which the rotation speed of the compressor 11 is controlled depending on the heat medium inlet temperature of the use side heat exchanger 35*a* to control the flow rate of the refrigerant on the heat source side.

In the air-conditioning apparatus according to Embodiment, in the case where the heat medium inlet temperature Twi of the use side heat exchanger 35*a* is below the predetermined range, the target heat medium temperature difference ΔTwm is reduced. Accordingly, for example, if the operation state is switched from a state where only the indoor unit 2*a* connected to the relay unit 3*a* performs the heating operation to another state where all of the indoor units 2*a*, 2*b*, and 2*c* perform the heating operation and the temperature efficiency ratio ε of the intermediate heat exchanger 31*a* accordingly decreases and the heat medium inlet temperature Twi falls, the mean temperature of the heat medium in the intermediate heat exchanger 31*a* can be raised because the target heat medium temperature difference ΔTwm is reduced. In other words, a reduction in the temperature of air blown from the indoor unit 2*a* can be prevented. Additionally, when the temperature of the heat medium or the temperature of air in an indoor space is low upon, for example, activation of the air-conditioning apparatus, the flow rate of the heat medium can be increased. Thus, the temperature of the air in the indoor space can be rapidly raised, so that comfort can be provided to the user.

The control for changing the target heat medium temperature difference ΔTwm of the operating use side heat exchanger 35 (indoor unit 2) described in Embodiment is particularly effective when the plurality of intermediate heat exchangers 31 (relay units 3) are arranged and at least one of the indoor units 2 connected to each of the intermediate heat exchangers 31 (relay units 3) is performing the heating operation.

If a plurality of use side heat exchangers 35 (indoor units 2) are operating when the heat medium inlet temperature Twi of the use side heat exchanger 35*a* exceeds the predetermined range, it is most desirable to control all of the operating use side heat exchangers 35 (indoor units 2) so as to increase the target heat medium temperature difference ΔTwm. If at least one of the operating use side heat exchangers 35 (indoor units 2) is controlled such that the target heat medium temperature difference ΔTwm is increased, however, it is sufficiently effective. Controlling at least one of the operating use side heat exchangers 35 (indoor units 2) so as to increase the target heat medium temperature difference ΔTwm results in a reduction of the heat medium outlet temperature of the intermediate heat exchanger 31*a*. Accordingly, the air outlet temperature (i.e., the temperature of air blown from the indoor unit 2) in each operating use side heat exchanger 35 which is not subjected to the control can be prevented from excessively rising. Thus, comfort can be provided to the user. Additionally, start-stop loss in the air-conditioning apparatus caused by a repetition of operation and stop can be reduced.

As described above, in the air-conditioning apparatus according to Embodiment, increasing the target heat medium temperature difference ΔTwm of the use side heat exchanger 35*a* is effective when the number of operating indoor units 2 is reduced while the air inlet temperature of each indoor unit 2 performing the heating operation is constant. For example, it is effective when the air inlet temperature of the use side heat exchanger 35*a* rises, that is, when the heating load decreases. The reason is as follows: The increase of the air inlet temperature leads to a reduction in the opening degree of the heat medium flow control device 45*a* as described above, thus reducing the flow rate of the heat medium of the use side heat exchanger 35*a*. Consequently, the flow rate of the heat medium of the intermediate heat exchanger 31*a* is reduced, thus enhancing the temperature efficiency ratio ε.

In the air-conditioning apparatus according to Embodiment, since the target heat medium temperature difference ΔTwm is set on the basis of the heat medium inlet temperature of the use side heat exchanger 35*a*, that is, the heat medium outlet temperature of the intermediate heat exchanger 31*a*, an excess of heating capacity of the use side heat exchanger 35*a* which would lead to an increase of the temperature of air blown from the indoor unit 2 can be prevented, irrespective of the number and size of use side heat exchangers 35*a* connected to the relay unit 3*a*.

Although the advantages in the heating operation in the air-conditioning apparatus according to Embodiment have been described above, the same advantages can be offered in the cooling operation of the air-conditioning apparatus. During the cooling operation, if the temperature efficiency ratio ε of the intermediate heat exchanger 31*a* increases, the heat medium inlet temperature of the use side heat exchanger 35*a* would fall too low, so that the temperature of cooled air blown from the indoor unit 2 would be too low. Unfortunately, the user may suffer discomfort and start-stop loss in the air-conditioning apparatus may be caused due to a repetition of operation and stop. Increasing the target heat medium temperature difference ΔTwm therefore can prevent a reduction of the temperature of cooled air blown from the indoor unit 2.

Specifically, if the heat medium inlet temperature Twi of the use side heat exchanger 35*a* is below the lower limit of the predetermined range while the use side heat exchanger 35*a* is operating as an evaporator, increasing the target heat medium temperature difference ΔTwm can prevent a reduction of the temperature of cooled air blown from the indoor unit 2, thus preventing the user from suffering discomfort and further preventing a repetition of operation and stop of the air-conditioning apparatus which would cause start-stop loss. In addition, if the heat medium inlet temperature Twi of the use side heat exchanger 35*a* exceeds the upper limit of the predetermined range, reducing the target heat medium temperature difference ΔTwm can reduce the mean temperature of the heat medium in the intermediate heat exchanger 31*a*. In other words, the temperature of air blown from the indoor unit 2*a* can be prevented from rising. Additionally, the temperature of air in an indoor space can be more rapidly cooled upon activation of the air-conditioning apparatus or when the temperature of the heating medium or the air in the indoor space is high, for example.

Furthermore, since the relay units 3*a*, 3*b*, and 3*c* of the air-conditioning apparatus according to Embodiment are arranged in the respective non-air-conditioning target spaces 302*a*, 302*b*, and 302*c*, the refrigerant can be prevented from entering an indoor space in case of leakage of the refrigerant. Accordingly, a flammable refrigerant, such as propane, can be used, so long as the non-air-conditioning target spaces 302*a*, 302*b*, and 302*c* can be ventilated adequately.

In the air-conditioning apparatus according to Embodiment, the rotation speed of the compressor 11 in the heat source unit 1 is controlled such that a given condensing temperature is provided during the heating operation or a given evaporating temperature is provided during the cooling operation. Accordingly, if the target heat medium temperature difference ΔTwm is changed such that the flow rate of the heat medium is reduced, an excessive increase in condensing temperature which would cause abnormal stop or an excessive reduction in evaporating temperature which would allow the heat medium to freeze can be prevented.

Although no mention of rotation speed control for the pump 41*a* in the air-conditioning apparatus is made in Embodiment, the controller 202*a* may change the rotation speed of the pump 41*a*. In this case, more energy can be saved by controlling the rotation speed of the pump 41*a* such that the largest one of the opening degrees of the heat medium flow control devices 45*a*, 45*b*, and 45*c* reaches the maximum opening degree.

In the air-conditioning apparatus according to Embodiment, the stable range (the range of −ΔTws to ΔTws) is set to control the opening degree L of the heat medium flow control device 45*a*. In addition, the stable range (the range of −Twis to Twis) is set to change the target heat medium temperature difference ΔTwm of the use side heat exchanger 35*a*. Since the stable ranges are set, the frequency of controlling the opening degree L of the heat medium flow control device 45*a* can be reduced, thus increasing the life of the heat medium flow control device 45*a*.

Figure 7:
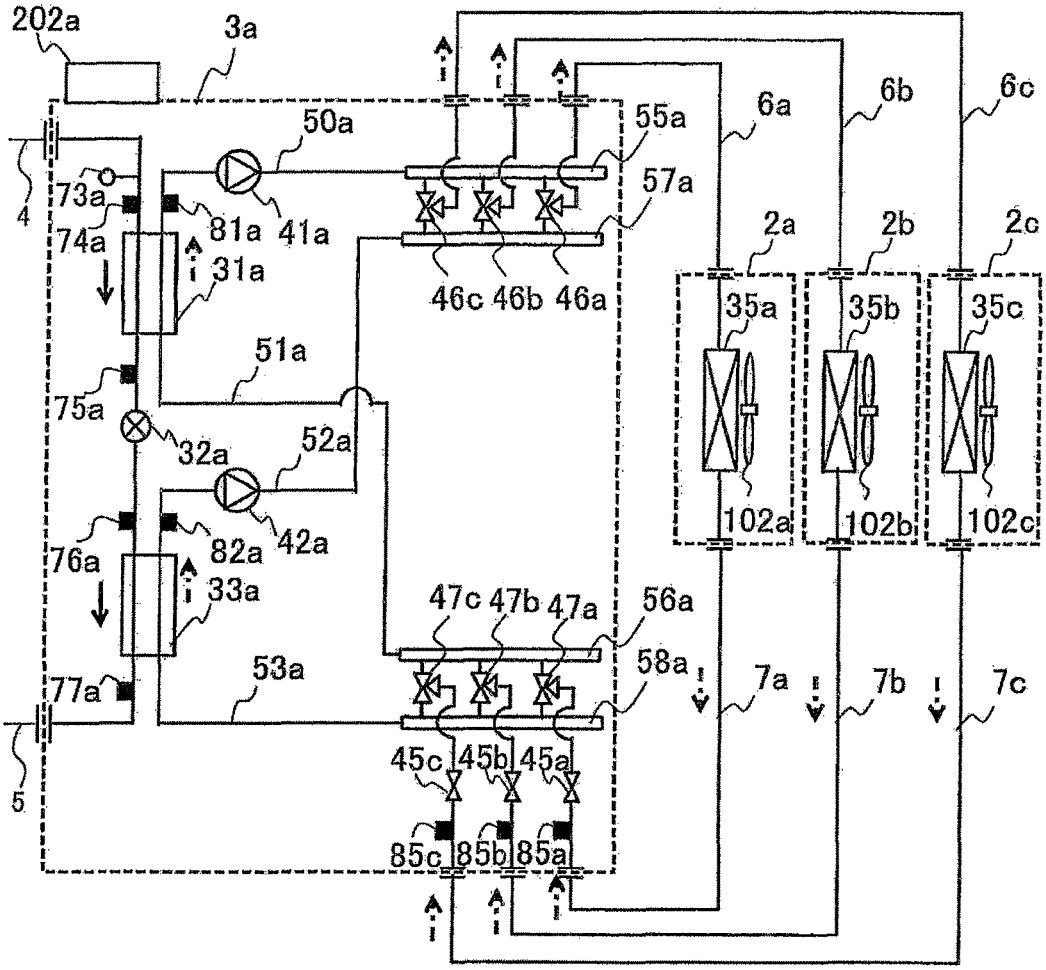
FIG. 7 is a system circuit diagram illustrating another exemplary relay unit in the air-conditioning apparatus according to Embodiment of the invention.

Although the air-conditioning apparatus according to Embodiment is an air-conditioning apparatus configured such that the indoor units 2 operate in the same operation mode (the cooling operation or the heating operation), it may be an air-conditioning apparatus capable of performing a cooling and heating mixed operation such that any of the cooling operation and the heating operation can be selected and performed in each indoor unit 2. For example, the relay unit 3*a* in FIG. 1 may be configured like a relay unit 3*a* as illustrated in FIG. 7, thus achieving an air-conditioning apparatus capable of performing the cooling and heating mixed operation. In such an air-conditioning apparatus capable of performing the cooling and heating mixed operation, the control for changing the target heat medium temperature difference ΔTwm of the use side heat exchanger 35 (indoor unit 2) which is operating can be performed.

FIG. 7 is a system circuit diagram illustrating another exemplary relay unit of the air-conditioning apparatus according to Embodiment of the invention. The relay unit 3*a* in FIG. 7 is connected to the heat source unit 1 illustrated in FIG. 1 by the gas pipe 4 and the liquid pipe 5, thus achieving an air-conditioning apparatus capable of performing the cooling and heating mixed operation. The air-conditioning apparatus with such a configuration will be described below.

The expansion device 32*a* is disposed in a refrigerant passage connecting between the intermediate heat exchanger 31*a* and an intermediate heat exchanger 33*a*. Accordingly, allowing a high-pressure refrigerant obtained by compression by the compressor 11 to flow in a direction indicated by solid-line arrows in FIG. 7 causes the intermediate heat exchanger 31*a* to function as a condenser and the intermediate heat exchanger 33*a* to function as an evaporator, thus achieving the cooling and heating mixed operation. Furthermore, allowing the high-pressure refrigerant obtained by compression by the compressor 11 to flow in a direction opposite to that indicated by the solid-line arrows in FIG. 7 causes the intermediate heat exchanger 31*a* to function as an evaporator and the intermediate heat exchanger 33*a* to function as a condenser, thus achieving the cooling and heating mixed operation. The heat medium outlet of the intermediate heat exchanger 31*a* is connected through the first heat medium passage 50*a* to the heat medium dividing portion 55*a*. The heat medium inlet of the intermediate heat exchanger 31*a* is connected through the second heat medium passage 51*a* to the heat medium combining portion 56*a*. In addition, a heat medium outlet of the intermediate heat exchanger 33*a* is connected through a first heat medium passage 52*a* to a heat medium dividing portion 57*a*. A heat medium inlet of the intermediate heat exchanger 33*a* is connected through a second heat medium passage 53*a* to a heat medium combining portion 58*a*.

The pump 41*a* is configured to suck the heat medium heated or cooled in the intermediate heat exchanger 31*a* and direct the resultant heat medium to the first heat medium passage 50*a* and the heat medium dividing portion 55*a*. A pump 42*a* is configured to suck the heat medium cooled or heated in the intermediate heat exchanger 33*a* and direct the resultant heat medium to the first heat medium passage 52*a* and the heat medium dividing portion 57*a*.

Heat medium flow switching devices 46*a*, 46*b*, and 46*c*, such as three-way valves, are configured to connect any of the heat medium dividing portion 55*a*, used for one of heating and cooling purposes, and the heat medium dividing portion 57*a*, used for the other one of them, to the heat medium supply passages 6*a*, 6*b*, and 6*c*, respectively. Accordingly, for example, if the indoor units 2*a* and 2*b* perform the heating operation, the heat medium for heating flows into the use side heat exchangers 35*a* and 35*b*. If the indoor unit 2*c* performs the cooling operation, the heat medium for cooling flows into the use side heat exchanger 35*c*.

Heat medium flow switching devices 47*a*, 47*b*, and 47*c* are configured to connect the heat medium return passages 7*a*, 7*b*, and 7*c* to any of the heat medium combining portion 56*a*, used for one of the heating and cooling purposes, and the heat medium combining portion 58*a*, used for the other one of them, respectively. For example, while the intermediate heat exchanger 31*a* operates as a condenser and the intermediate heat exchanger 33*a* operates as an evaporator, the heat medium flowing through the heat medium return passages 7*a* and 7*b* flows into the heat medium combining portion 56*a* and the heat medium flowing through the heat medium return passage 7*c* flows into the heat medium combining portion 58*a*.

The relay unit 3*a* illustrated in FIG. 7 includes the pressure sensor 73*a* to detect the pressure of the refrigerant flowing through the intermediate heat exchanger 31*a*, the temperature sensor 74*a* to detect the temperature of the refrigerant flowing into the intermediate heat exchanger 31*a*, and the temperature sensor 75*a* to detect the temperature of the refrigerant flowing out of the intermediate heat exchanger 31*a*, as the relay unit 3*a* illustrated in FIG. 1. The relay unit 3 illustrated in FIG. 7 further includes a temperature sensor 76*a* to detect the temperature of the refrigerant flowing into the intermediate heat exchanger 33*a* and a temperature sensor 77*a* to detect the temperature of the refrigerant flowing out of the intermediate heat exchanger 33*a*. Accordingly, while the intermediate heat exchanger 31*a* operates as a condenser, the controller 202*a* can obtain the degree of subcooling in the intermediate heat exchanger 31*a* by calculating the difference between a saturation temperature converted from the pressure detected by the pressure sensor 73*a* and the temperature detected by the temperature sensor 75*a*. While the intermediate heat exchanger 31*a* operates as an evaporator, the controller 202*a* can obtain the degree of superheat in the intermediate heat exchanger 31*a* by calculating the difference between the temperature detected by the temperature sensor 74*a* and the temperature detected by the temperature sensor 75*a*. In addition, the controller 202*a* can obtain the degree of subcooling and the degree of superheat in the intermediate heat exchanger 31*a* by calculating the difference between the temperature detected by the temperature sensor 76*a* and the temperature detected by the temperature sensor 77*a*, When the sum of heating loads on the indoor units 2 is greater than the sum of cooling loads thereon, the controller 202*a* controls the opening degree of the expansion device 32*a* such that the degree of subcooling in the intermediate heat exchanger (one of the intermediate heat exchangers 31*a* and 33*a*) operating as a condenser reaches a given target value. On the other hand, when the sum of cooling loads on the indoor units 2 is greater than the sum of heating loads thereon, the controller 202*a* controls the opening degree of the expansion device 32*a* such that the degree of superheat in the intermediate heat exchanger (the other one of the intermediate heat exchangers 31*a* and 33*a*) operating as an evaporator reaches a given target value.

In the air-conditioning apparatus with the above-described configuration, a temperature detected by the temperature sensor 81*a* is used as a heat medium inlet temperature Twih of the indoor unit 2 performing the heating operation and a temperature detected by the temperature sensor 82*a* is used as a heat medium inlet temperature Twic of the indoor unit 2 performing the cooling operation. A target heating heat medium temperature difference ΔTwmh and a target cooling heat medium temperature difference ΔTwmc can be set (or changed) in the indoor unit 2 performing the heating operation and the indoor unit 2 performing the cooling operation, respectively.

In the air-conditioning apparatus capable of performing the cooling and heating mixed operation, in the case where the sum of heating loads on the indoor units 2 is greater than the sum of cooling loads thereon, the heat source side heat exchanger 13 may be allowed to operate as an evaporator by switching the four-way valve 12 in the heat source unit 1 such that the passage for the refrigerant discharged from the compressor 11 is connected to the intermediate heat exchanger 31*a*. On the other hand, in the case where the sum of cooling loads on the indoor units 2 is greater than the sum of heating loads thereon, the heat source side heat exchanger 13 may be allowed to operate as a condenser by switching the four-way valve 12 in the heat source unit 1 such that the passage for the refrigerant discharged from the compressor 11 is connected to the heat source side heat exchanger 13. Using the heat source side heat exchanger 13 as an evaporator or a condenser in the above-described manner enhances the efficiency of the refrigeration cycle in the air-conditioning apparatus.

Specifically, in the case where the sum of heating loads on the indoor units 2 is greater than the sum of cooling loads thereon, the controller 201 allows the heat source side heat exchanger 13 to operate as an evaporator in the manner as follows: The controller 201 switches the four-way valve 12 such that the passage for the refrigerant discharged from the compressor 11 is connected to the intermediate heat exchanger 31*a*. Thus, the high-pressure refrigerant discharged from the compressor 11 flows into the intermediate heat exchanger 31*a*, which operates as a condenser. Furthermore, the refrigerant leaving the intermediate heat exchanger 33*a*, which operates as an evaporator, flows into the heat source side heat exchanger 13. At that time, the controller 201 controls the rotation speed of the compressor 11 such that the condensing temperature in the intermediate heat exchanger 31*a*, serving as a condenser, reaches a target condensing temperature. In addition, the controller 201 controls the amount of heat exchange in the heat source side heat exchanger 13 such that the evaporating temperature in the intermediate heat exchanger 33*a*, serving as an evaporator, reaches a target evaporating temperature. The amount of heat exchange in the heat source side heat exchanger 13 is controlled by, for example, changing the rotation speed of the fan 101 corresponding to a heat exchange amount control device in the invention.

Furthermore, in the case where the sum of cooling loads on the indoor units 2 is greater than the sum of heating loads thereon, the controller 201 allows the heat source side heat exchanger 13 to operate as a condenser as follows: The controller 201 switches the four-way valve 12 such that the passage for the refrigerant discharged from the compressor 11 is connected to the heat source side heat exchanger 13. Consequently, the refrigerant leaving the heat source side heat exchanger 13 flows into the intermediate heat exchanger 33*a*, which operates as a condenser. Additionally, the refrigerant leaving the intermediate heat exchanger 31*a*, which operates as an evaporator, flows into the accumulator 14, passes through the accumulator 14, and then flows into the compressor. At this time, the controller 201 controls the amount of heat exchange in the heat source side heat exchanger 13 such that the condensing temperature in the intermediate heat exchanger 33*a*, serving as a condenser, reaches a target condensing temperature. In addition, the controller 201 controls the rotation speed of the compressor 11 such that the evaporating temperature in the intermediate heat exchanger 31*a*, serving as an evaporator, reaches a target evaporating temperature. The amount of heat exchange in the heat source side heat exchanger 13 is controlled by, for example, changing the rotation speed of the fan 101 corresponding to the heat exchange amount control device in the invention.

Since the heat source side heat exchanger 13 is used as a condenser or an evaporator depending on the sum of cooling loads on the indoor units 2 and the sum of heating loads thereon in the above-described manner, the efficiency of the refrigeration cycle in the air-conditioning apparatus is enhanced.

Figure 8:
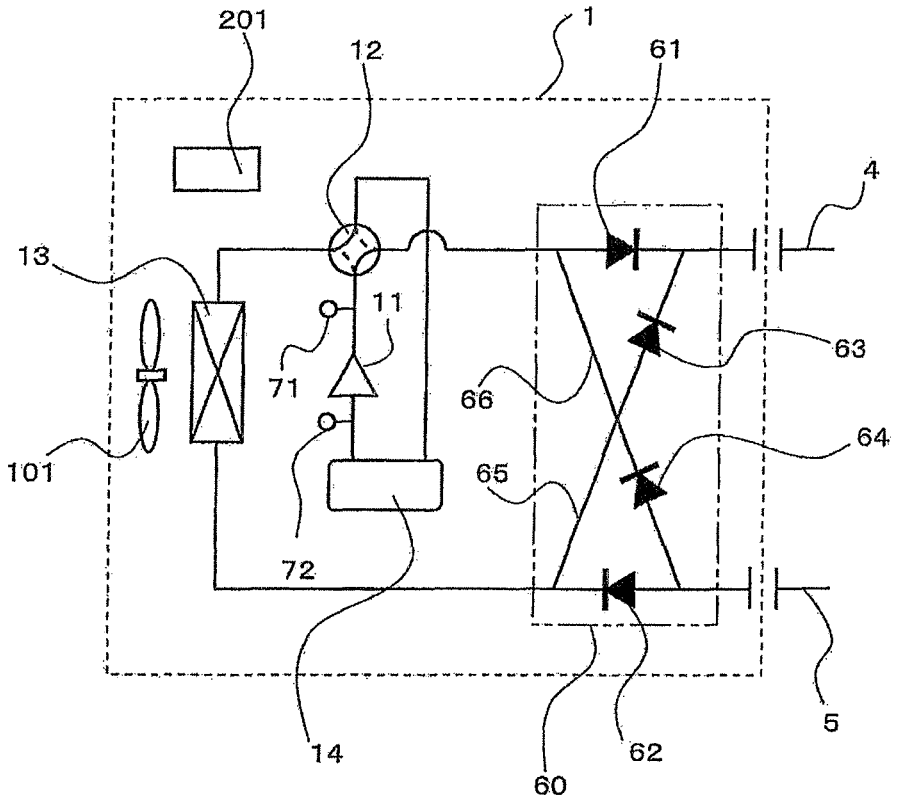
FIG. 8 is a system circuit diagram illustrating an exemplary heat source unit connected to the relay unit illustrated in FIG. 7.

In the case where the refrigerant flows in only one direction (indicated by the arrows) in the relay unit 3*a* as illustrated in FIG. 7, the heat source side heat exchanger 13 can be used as an evaporator or a condenser by, for example, connecting a heat source unit 1 illustrated in FIG. 8 to the relay unit 3*a*.

FIG. 8 is a system circuit diagram illustrating an exemplary heat source unit connected to the relay unit illustrated in FIG. 7.

The heat source unit 1 illustrated in FIG. 8 includes a refrigerant flow switching device 60 in addition to the components of the heat source unit 1 illustrated in FIG. 1. The refrigerant flow switching device 60 includes check valves 61, 62, 63, and 64 and connecting pipes 65 and 66.

In the heat source unit 1 with the above-described configuration, in the case where the sum of heating loads on the indoor units 2 is greater than the sum of cooling loads thereon, the controller 201 allows the heat source side heat exchanger 13 to operate as an evaporator as follows: The controller 201 switches the four-way valve 12 such that the suction side of the compressor 11 is connected to the heat source side heat exchanger 13. Consequently, the high-pressure refrigerant discharged from the compressor 11 flows through the check valve 61 into the intermediate heat exchanger 31*a*. Furthermore, the refrigerant leaving the intermediate heat exchanger 33*a* flows through the check valve 62 into the heat source side heat exchanger 13. At this time, the controller 201 controls the rotation speed of the compressor 11 such that the condensing temperature in the intermediate heat exchanger 31*a*, serving as a condenser, reaches a target condensing temperature. In addition, the controller 201 controls the amount of heat exchange in the heat source side heat exchanger 13 such that the evaporating temperature in the intermediate heat exchanger 33*a*, serving as an evaporator, reaches a target evaporating temperature. The amount of heat exchange in the heat source side heat exchanger 13 is controlled by, for example, changing the rotation speed of the fan 101 corresponding to the heat exchange amount control device in the invention.

Furthermore, in the case where the sum of cooling loads on the indoor units 2 is greater than the sum of heating loads thereon, the controller 201 allows the heat source side heat exchanger 13 to operate as a condenser as follows: The controller 201 switches the four-way valve 12 such that the discharge side of the compressor 11 is connected to the heat source side heat exchanger 13. Consequently, the refrigerant leaving the heat source side heat exchanger 13 flows through the check valve 63 and the connecting pipe 65 into the intermediate heat exchanger 31*a*. In addition, the refrigerant leaving the intermediate heat exchanger 33*a* flows through the check valve 64 and the connecting pipe 66 into the accumulator 14, passes through the accumulator 14, and flows into the compressor. At this time, the controller 201 controls the amount of heat exchange in the heat source side heat exchanger 13 such that the condensing temperature in the intermediate heat exchanger 31*a*, serving as a condenser, reaches a target condensing temperature. In addition, the controller 201 controls the rotation speed of the compressor 11 such that the evaporating temperature in the intermediate heat exchanger 33*a*, serving as an evaporator, reaches a target evaporating temperature. The amount of heat exchange in the heat source side heat exchanger 13 is controlled by, for example, changing the rotation speed of the fan 101 corresponding to the heat exchange amount control device in the invention.

In the air-conditioning apparatus with the above-described configuration, since the heat source side heat exchanger 13 is used as a condenser or an evaporator depending on the sum of cooling loads on the indoor units 2 and the sum of heating loads thereon, the efficiency of the refrigeration cycle in the air-conditioning apparatus is enhanced.

Although the relay unit 3*a* illustrated in FIG. 7 is configured such that the intermediate heat exchanger 31*a* can be connected in series with the intermediate heat exchanger 33*a*, it may be configured such that the connection between the intermediate heat exchangers 31*a* and 33*a* can be switched between series and parallel connections. For example, in the case where all of the operating indoor units 2 are in the cooling operation mode (i.e., in a cooling only operation), the intermediate heat exchanger 31*a* is connected in parallel with the intermediate heat exchanger 33*a* such that the refrigerant flows into both of them, thus allowing the intermediate heat exchangers 31*a* and 33*a* to operate as evaporators. Consequently, the area of heat transfer provided by the evaporators can be increased, thus enhancing operation efficiency of the air-conditioning apparatus. Similarly, in the case where all of the operating indoor units 2 are in the heating operation mode (i.e., in a heating only operation), the intermediate heat exchanger 31*a* is connected in parallel with the intermediate heat exchanger 33*a* such that the refrigerant flows into both of them, thus allowing the intermediate heat exchangers 31*a* and 33*a* to operate as condensers. Consequently, the area of heat transfer provided by the condensers can be increased, thus enhancing the operation efficiency of the air-conditioning apparatus.

INDUSTRIAL APPLICABILITY

Applications of the present invention include an air-conditioning apparatus that allows a heat medium to circulate through an indoor unit and a chiller that generates hot water or cold water.

REFERENCE SIGNS LIST heat source unit (outdoor unit) 2 indoor unit 3 relay unit 4 gas pipe 5 liquid pipe 6 heat medium supply passage 7 heat medium return passage 11 compressor 12 four-way valve 13 heat source side heat exchanger 14 accumulator 31, 33 intermediate heat exchanger 32 expansion device 35 use side heat exchanger 41, 42 pump 45 heat medium flow control device 46, 47 heat medium flow switching device 50, 52 first heat medium passage 51, 53 second heat medium passage 55 heat medium dividing portion (heating heat medium dividing portion) 56 heat medium combining portion (heating heat medium combining portion) 57 heat medium dividing portion (cooling heat medium dividing portion) 58 heat medium combining portion (cooling heat medium combining portion) 60 refrigerant flow switching device 61, 62, 63, 64 check valve 65, 66 connecting pipe 71, 72, 73 pressure sensor 74, 75, 76, 77, 81, 82, 85 temperature sensor 101, 102 fan 201, 202 controller 301 structure 302 non-air-conditioning target space 303 indoor space

The invention claimed is:

1. An air-conditioning apparatus comprising:

a refrigeration cycle in which a compressor, a refrigerant passage of at least one intermediate heat exchanger operating as a condenser or an evaporator, an expansion device, and a heat source side heat exchanger are connected by pipes and through which a refrigerant circulates;

a heat transfer medium circuit in which a heat transfer medium passage of the intermediate heat exchanger, a heat transfer medium circulating device, a use side heat exchanger, and a heat transfer medium flow control device disposed corresponding to the use side heat exchanger are connected by pipes and through which a heat transfer medium circulates;

a controller configured to control the heat transfer medium flow control device in order to adjust the flow rate of the heat transfer medium flowing through the use side heat exchanger;

a first heat transfer medium temperature detecting device configured to detect the temperature of the heat transfer medium flowing into the use side heat exchanger; and a second heat transfer medium temperature detecting device disposed corresponding to the use side heat exchanger, the second heat transfer medium temperature detecting device being configured to detect the temperature of the heat transfer medium flowing out of the use side heat exchanger, wherein the controller is configured to:

calculate a heat transfer medium temperature difference which is the difference between a detected value of the first heat transfer medium temperature detecting device and a detected value of the second heat transfer medium temperature detecting device for the use side heat exchanger which is operating, and control the heat transfer medium flow control device such that the heat transfer medium temperature difference reaches a target heat transfer medium temperature difference which is a target value of the difference between the detected value of the first heat transfer medium temperature detecting device and the detected value of the second heat transfer medium temperature detecting device, while the intermediate heat exchanger operates as a condenser in the refrigeration cycle:

increase the target heat transfer medium temperature difference when the detected value of the first heat transfer medium temperature detecting device is greater than an upper limit of a predetermined range, and reduce the target heat transfer medium temperature difference when the detected value of the first heat transfer medium temperature detecting device is less than a lower limit of the predetermined range, and while the intermediate heat exchanger operates as an evaporator in the refrigeration cycle, increase the target heat transfer medium temperature difference when the detected value of the first heat transfer medium temperature detecting device is less than a lower limit of the predetermined range, and reduce the target heat transfer medium temperature difference when the detected value of the first heat transfer medium temperature detecting device is greater than an upper limit of the predetermined range.

2. The air-conditioning apparatus of claim 1, wherein the at least one intermediate heat exchanger includes a plurality of intermediate heat exchangers, and the heat transfer medium circuit is connected to each of the plurality of intermediate heat exchangers.

3. The air-conditioning apparatus of claim 2, wherein the refrigeration cycle is configured such that at least one of the plurality of intermediate heat exchangers operates as a condenser in the refrigeration cycle to allow the use side heat exchanger to perform a heating operation, and at least one of the other of the plurality of intermediate heat exchangers operates as an evaporator in the refrigeration cycle to allow the use side heat exchanger to perform a cooling operation.

4. The air-conditioning apparatus of claim 1, wherein the heat transfer medium flow control device is a flow control valve, wherein the controller is further configured to when the heat transfer medium temperature difference is greater than the target heat transfer medium temperature difference, increase an opening degree of the flow control valve, and when the heat transfer medium temperature difference is less than the target heat transfer medium temperature difference, reduce the opening degree of the flow control valve.

5. The air-conditioning apparatus of claim 1, wherein the controller is further configured to when a heating load is greater than a cooling load, control a rotation speed of the compressor such that a condensing temperature of the refrigerant flowing through the intermediate heat exchanger operating as a condenser reaches a target condensing temperature.

6. The air-conditioning apparatus of claim 1, wherein the controller is further configured to when a cooling load is greater than a heating load, control a rotation speed of the compressor such that an evaporating temperature of the refrigerant flowing through the intermediate heat exchanger operating as an evaporator reaches a target evaporating temperature.

7. The air-conditioning apparatus of claim 3, wherein the heat source side heat exchanger includes a heat exchange amount control device configured to adjust the amount of heat exchange, wherein the controller is further configured to when a heating load is greater than a cooling load, allow the heat source side heat exchanger to operate as an evaporator, control a rotation speed of the compressor such that a condensing temperature of the refrigerant flowing through the intermediate heat exchanger operating as a condenser reaches a first target condensing temperature, and control the heat exchange amount control device such that an evaporating temperature of the refrigerant flowing through the intermediate heat exchanger operating as an evaporator reaches a first target evaporating temperature, and when the cooling load is greater than the heating load, allow the heat source side heat exchanger to operate as a condenser, control the heat exchange amount control device such that the condensing temperature of the refrigerant flowing through the intermediate heat exchanger operating as a condenser reaches a second target condensing temperature, and control the rotation speed of the compressor such that the evaporating temperature of the refrigerant flowing through the intermediate heat exchanger operating as an evaporator reaches a second target evaporating temperature.

8. The air-conditioning apparatus of claim 1, wherein the compressor is accommodated in a heat source unit, wherein the intermediate heat exchangers are separately accommodated in a plurality of relay units, wherein the controller is separated into a heat source unit control device provided for the heat source unit and relay unit control devices provided for the respective relay units, wherein the heat source unit control device is configured to control a rotation speed of the compressor, and wherein each of the relay unit control devices is configured to control the flow rate of the heat transfer medium flowing through the intermediate heat exchanger accommodated in the corresponding relay unit for which the relay unit control device is provided.

9. The air-conditioning apparatus of claim 2, wherein the refrigeration cycle is configured such that at least two of the plurality of intermediate heat exchangers simultaneously serve a single function as a condenser or an evaporator.

10. The air-conditioning apparatus of claim 1, wherein the controller is further configured to:

control an opening degree of the heat transfer medium flow control device to be set to a maximum value, and then iteratively perform the following during a heating operation:

maintain the opening degree of the heat transfer medium flow control device for a predetermined period of time, and after the predetermined period of time expires, allow the first heat transfer medium temperature detecting device to detect the temperature of the heat transfer medium flowing into the use side heat exchanger and allow the second heat transfer medium temperature detecting device to detect the temperature of the heat transfer medium flowing out of the use side heat exchanger, and then calculate the heat transfer medium temperature difference between the detected value of the first heat transfer medium temperature detecting device and the detected value of the second heat transfer medium temperature detecting device, and then:

in response to the heat transfer medium temperature difference being calculated as above an upper limit of the target heat transfer medium temperature difference which is a predetermined stable range, control the opening degree of the heat medium flow control device to be reduced by a predetermined amount to not less than a minimum degree of being open, to reduce the flow rate of the heat medium, in response to the heat transfer medium temperature difference being calculated as below a lower limit of the stable range, control the opening degree of the heat medium flow control device to be increased by a predetermined amount to increase the flow rate of the heat medium, in response to the heat transfer medium temperature difference being calculated as within the predetermined stable range, leaving the opening degree of the heat medium flow control device.

11. An air-conditioning apparatus comprising:

a refrigeration cycle in which a compressor, a refrigerant passage of at least one intermediate heat exchanger operating as a condenser or an evaporator, an expansion device, and a heat source side heat exchanger are connected by pipes and through which a refrigerant circulates;

a heat transfer medium circuit in which a heat transfer medium passage of the intermediate heat exchanger, a heat transfer medium circulating device, a use side heat exchanger, and a heat transfer medium flow control device disposed corresponding to the use side heat exchanger are connected by pipes and through which a heat transfer medium circulates;

a controller configured to control the heat transfer medium flow control device in order to adjust the flow rate of the heat transfer medium flowing through the use side heat exchanger;

a first heat transfer medium temperature detecting device configured to detect the temperature of the heat transfer medium flowing into the use side heat exchanger; and a second heat transfer medium temperature detecting device disposed corresponding to the use side heat exchanger, the second heat transfer medium temperature detecting device being configured to detect the temperature of the heat transfer medium flowing out of the use side heat exchanger, wherein the controller is configured to:

calculate a heat transfer medium temperature difference which is the difference between a detected value of the first heat transfer medium temperature detecting device and a detected value of the second heat transfer medium temperature detecting device for the use side heat exchanger which is operating, and control the heat transfer medium flow control device such that the heat transfer medium temperature difference reaches a target heat transfer medium temperature difference which is a target value of the difference between the detected value of the first heat transfer medium temperature detecting device and the detected value of the second heat transfer medium temperature detecting device, and in response to the detected value of the first heat transfer medium temperature detecting device deviating from a predetermined range, change the target heat transfer medium temperature difference and control the heat medium flow control device corresponding to the use side heat exchanger, which is operating, such that the heat transfer medium temperature difference reaches the changed target heat transfer medium temperature difference, wherein the at least one intermediate heat exchanger includes a plurality of intermediate heat exchangers, and the heat transfer medium circuit is connected to each of the plurality of intermediate heat exchangers, wherein the refrigeration cycle is configured such that at least one of the plurality of intermediate heat exchangers operates as a condenser in the refrigeration cycle to allow the use side heat exchanger to perform a heating operation, and at least one of the other of the plurality of intermediate heat exchangers operates as an evaporator in the refrigeration cycle to allow the use side heat exchanger to perform a cooling operation, wherein the heat source side heat exchanger includes a heat exchange amount control device configured to adjust the amount of heat exchange, wherein the controller is further configured to when a heating load is greater than a cooling load, allow the heat source side heat exchanger to operate as an evaporator, control a rotation speed of the compressor such that a condensing temperature of the refrigerant flowing through the intermediate heat exchanger operating as a condenser reaches a target condensing temperature, and control the heat exchange amount control device such that an evaporating temperature of the refrigerant flowing through the intermediate heat exchanger operating as an evaporator reaches a target evaporating temperature, and when the cooling load is greater than the heating load, allow the heat source side heat exchanger to operate as a condenser, control the heat exchange amount control device such that the condensing temperature of the refrigerant flowing through the intermediate heat exchanger operating as a condenser reaches the target condensing temperature, and control the rotation speed of the compressor such that the evaporating temperature of the refrigerant flowing through the intermediate heat exchanger operating as an evaporator reaches the target evaporating temperature.

* * * * *